US011799234B2

(12) United States Patent
Toyoda et al.

(10) Patent No.: US 11,799,234 B2
(45) Date of Patent: Oct. 24, 2023

(54) PROTECTOR AND WIRE HARNESS

(71) Applicant: Yazaki Corporation, Tokyo (JP)

(72) Inventors: Ryohei Toyoda, Aichi (JP); YoungHo Jang, Aichi (JP)

(73) Assignee: YAZAKI CORPORATION, Tokyo (JP)

( * ) Notice: Subject to any disclaimer, the term of this patent is extended or adjusted under 35 U.S.C. 154(b) by 107 days.

(21) Appl. No.: 17/708,710

(22) Filed: Mar. 30, 2022

(65) Prior Publication Data

US 2022/0368061 A1 Nov. 17, 2022

(30) Foreign Application Priority Data

May 13, 2021 (JP) ..... 2021-081442

(51) Int. Cl.
*H01R 13/516* (2006.01)

(52) U.S. Cl.
CPC ..... *H01R 13/516* (2013.01); *H01R 2201/26* (2013.01)

(58) Field of Classification Search
CPC ..... H01R 13/516; H01R 201/26
USPC ..... 439/309
See application file for complete search history.

(56) References Cited

U.S. PATENT DOCUMENTS 4,483,580 A * 11/1984 Pelczarski ..... H01R 13/516 439/460
4,923,310 A * 5/1990 Sekiguchi ..... H01R 13/516 439/701
5,688,144 A * 11/1997 Kosuge ..... H01R 13/516 439/466
6,171,136 B1 * 1/2001 Liu ..... H01R 13/506 439/465
6,814,581 B2 * 11/2004 Matsuo ..... H01R 13/5202 439/35
6,824,420 B2 * 11/2004 Ushiro ..... H01R 13/5816 439/468
6,962,504 B2 * 11/2005 Fukui ..... H01R 13/567 439/473
7,021,959 B2 * 4/2006 Tsuji ..... H01R 13/562 439/470
7,128,601 B2 * 10/2006 Suemitsu ..... H01R 13/567 439/521
7,931,483 B2 * 4/2011 Komiyama ..... H01R 13/62977 439/157
7,938,655 B2 * 5/2011 Komiyama ..... H01R 13/62977 439/157

(Continued)

FOREIGN PATENT DOCUMENTS

JP 2015-154596 A 8/2015

*Primary Examiner* — Alexander Gilman
(74) *Attorney, Agent, or Firm* — Sughrue Mion, PLLC

(57) ABSTRACT

A protector includes a base member and a cover member. The base member includes hooking portions, locking parts, inclined guides that go in the lower direction as going in the attachment direction, and horizontal guides that extend along the attachment direction. The cover member includes hooked portions provided on attachment direction-side ends of cover bilateral-side portions, locked portions provided on detachment direction-side ends and locked on the locking parts, and guided parts that are provided between the hooked portions and the locked parts in the attachment direction, and contact at least one of the inclined guides and the horizontal guides.

20 Claims, 17 Drawing Sheets

(56) References Cited

U.S. PATENT DOCUMENTS

| | | | | |
|---|---|---|---|---|
| 8,043,111 | B2 * | 10/2011 | Takahashi | F16L 33/02 174/72 A |
| 8,480,417 | B2 * | 7/2013 | Suemitsu | H01R 13/46 439/157 |
| 8,790,129 | B1 * | 7/2014 | Rengifo | H01R 13/521 439/468 |
| 9,711,890 | B1 * | 7/2017 | Lai | H01R 12/737 |
| 2005/0003698 | A1 * | 1/2005 | Hata | H02G 3/0691 439/470 |
| 2006/0009067 | A1 * | 1/2006 | Sakamaki | H01R 13/633 439/468 |
| 2006/0160384 | A1 * | 7/2006 | Brazina | H02G 3/0418 439/136 |
| 2012/0028486 | A1 * | 2/2012 | Suemitsu | H01R 13/56 439/157 |
| 2013/0189875 | A1 * | 7/2013 | Fukaya | H01R 13/73 439/533 |
| 2016/0315421 | A1 * | 10/2016 | Andou | H01R 11/12 |
| 2017/0246998 | A1 * | 8/2017 | Ogue | H01R 31/02 |
| 2018/0076567 | A1 * | 3/2018 | Ishida | H01R 13/582 |
| 2018/0109044 | A1 * | 4/2018 | Kawamura | H01R 13/516 |
| 2020/0113070 | A1 * | 4/2020 | Watanabe | H05K 5/0047 |
| 2020/0373710 | A1 * | 11/2020 | Gates | H01R 13/639 |
| 2022/0368061 | A1 * | 11/2022 | Toyoda | H01R 13/516 |

* cited by examiner

PROTECTOR AND WIRE HARNESS

CROSS-REFERENCE TO RELATED APPLICATION(S)

The present application claims priority to and incorporates by reference the entire contents of Japanese Patent Application No. 2021-081442 filed in Japan on May 13, 2021.

BACKGROUND OF THE INVENTION

1. Field of the Invention

The present invention relates to a protector and a wire harness.

2. Description of the Related Art

A vehicle such as an automobile includes a wire harness that mutually connects various devices in the vehicle. Such a wire harness includes a protector that protects a wiring member constituting the wire harness from the outside in some cases.

The protector has an accommodating space for accommodating the wiring member, and protects the wiring member by accommodating the wiring member in the accommodating space. This type of protector sometimes includes a cover member having an engagement claw, and a base member having an engagement hole that engages with the engagement claw (e.g., see Japanese Patent Application Laid-open No. 2015-154596).

In such a conventional protector, the cover member is provided with a plurality of the engagement claws, and the base member is provided with a plurality of the engagement holes. Each engagement claw is formed elastically deformable. First, in the conventional protector, the engagement claws are inserted into the respective engagement holes. After that, in the conventional protector, when the cover member moves toward the base member in an upper/lower direction so as to come close thereto, the engagement claws are locked to the engagement holes, an opening of the base member is closed by the cover member, and the cover member is attached to the base member.

Unfortunately, in the conventional protector, the operation of inserting the engagement claws into the engagement holes and the operation of closing the opening of the base member by the cover member need to be performed separately. This makes the attachment operation complicated.

SUMMARY OF THE INVENTION

The present invention has been made in view of the above circumstances, and it is an object thereof to provide a protector and a wire harness capable of facilitating an attachment operation of attaching a cover member to a base member.

In order to achieve the above mentioned object, a protector according to one aspect of the present invention includes a cover member that is attached to the base member, wherein the base member includes: a base body that is located in a center in a width direction orthogonal to an upper/lower direction, and base bilateral-side portions located on both sides in the width direction, the base bilateral-side portions include: hooking portions provided on attachment direction-side ends, a pair of inclined guides provided on a detachment direction side that is an opposite direction of the attachment direction of the hooking portion, and going in a lower direction as going in the attachment direction, a pair of horizontal guides each provided between the inclined guide and the hooking portion in the attachment direction, and extending along the attachment direction from a attachment direction-side end of the inclined guide, and a pair of locking parts provided on the detachment direction side of the inclined guide, the cover member includes an accommodating space, and a cover body that has a cover opening communicating with the accommodating space and located in the center of the width direction, and cover bilateral-side portions located on both sides in the width direction, the cover bilateral-side portions include a hooked portion that is provided at a attachment direction-side end and is hooked on the hooking portion, a pair of guided parts that are provided on the detachment direction side of the hooked portion, and come into contact with at least one of the inclined guide and the horizontal guide, and a pair of locked parts that are provided on the detachment direction side of the guided part, and locked on the locking part, and an inclined direction guiding operation is performed in which when the cover member is moved to the lower direction with the guided part coming into contact with the inclined guide, the cover member goes in the attachment direction as going in the lower direction; a horizontal guiding operation is performed to move the guided part to the horizontal guide from the inclined guide while the guided part is held to come into contact with the base member, and move the cover member to the attachment direction in a state in which the guided part comes into contact with the horizontal guide; and when the cover member is moved to a preset attachment position, the cover opening is closed by the base member and the hooking portion is hooked on the hooked portion, and a movement restricted state is performed in which the locking part is locked on the locked part, and in the movement restricted state, the movement of the cover member with respect to the base member is restricted in the attachment direction, the detachment direction, and the upper/lower direction.

In order to achieve the above mentioned object, a wire harness according to another aspect of the present invention includes a first wiring member having a conductive first core wire; a second wiring member having a conductive second core wire; a first connector having an end of the first wiring member inserted thereinto; a second connector having an end of the second wiring member inserted thereinto and being configured to be able to be fitted with the first connector; and the protector, wherein the first connector and the second connector electrically connect the first core wire and the second core wire in a fitting state, the base body is provided with the first connector, the cover body has a first through opening through which the first wiring member is inserted at the detachment direction-side end, and has a second through opening through which the second wiring member is inserted at the attachment direction-side end, the first wiring member is disposed in the base body along the detachment direction, the second wiring member is disposed in the base body along the attachment direction, and in the width direction in a state in which the second connector is fitted to the first connector, a wiring region is formed in which the first wiring member and the second wiring member are disposed between a pair of the inclined guides, between a pair of the horizontal guides, between a pair of hooking portions, and between a pair of the locking parts.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, an embodiment of a protector and a wire harness according to the present invention will be described based on the drawings. Note that the embodiment does not intend to limit the present invention. Additionally, constituent elements in the following embodiment include those easily conceivable by a person skilled in the art, or those substantially identical with the constituent elements.

Figure 1:
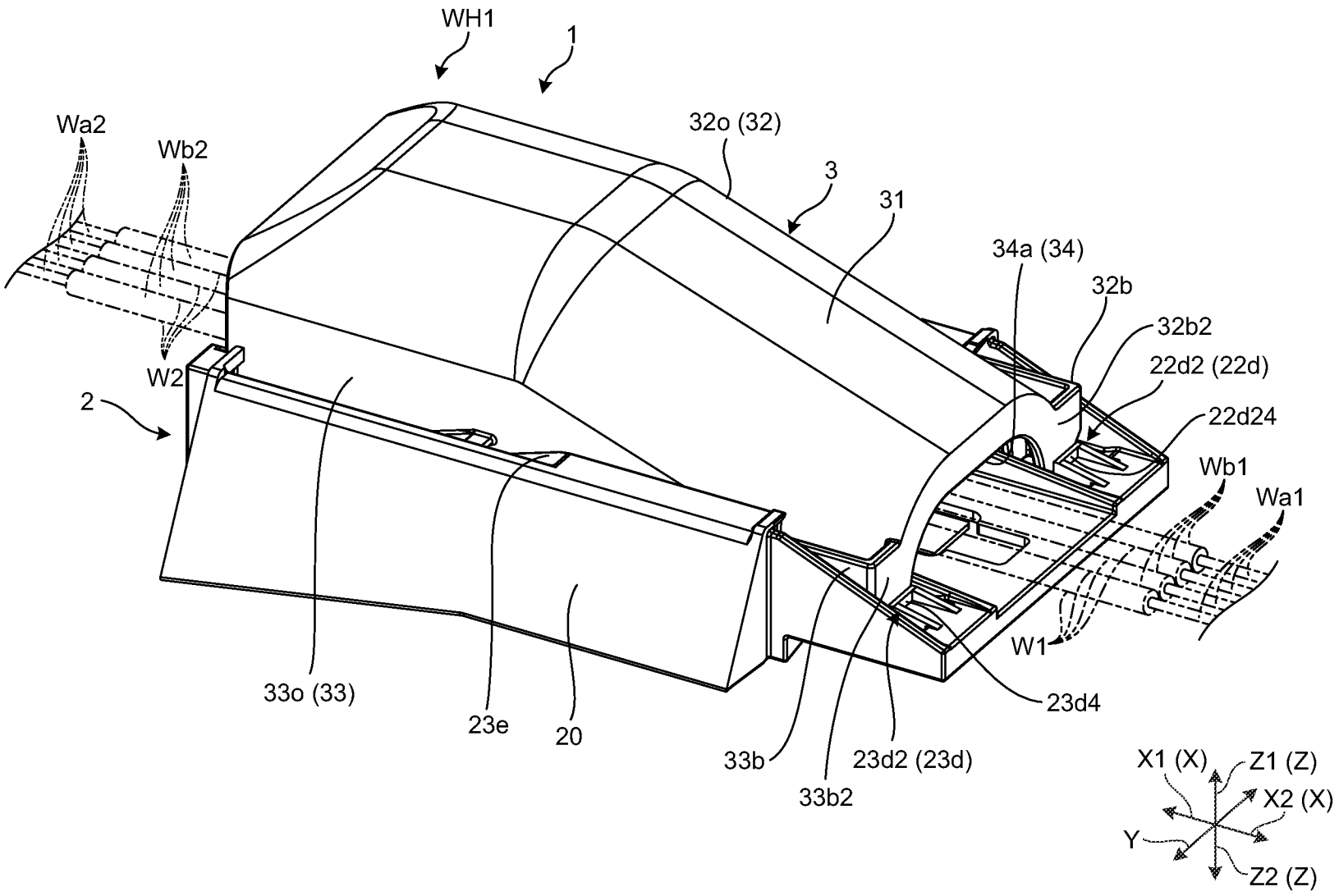
FIG. 1 is a perspective view of a wire harness including a protector according to a first embodiment.
Figure 2:
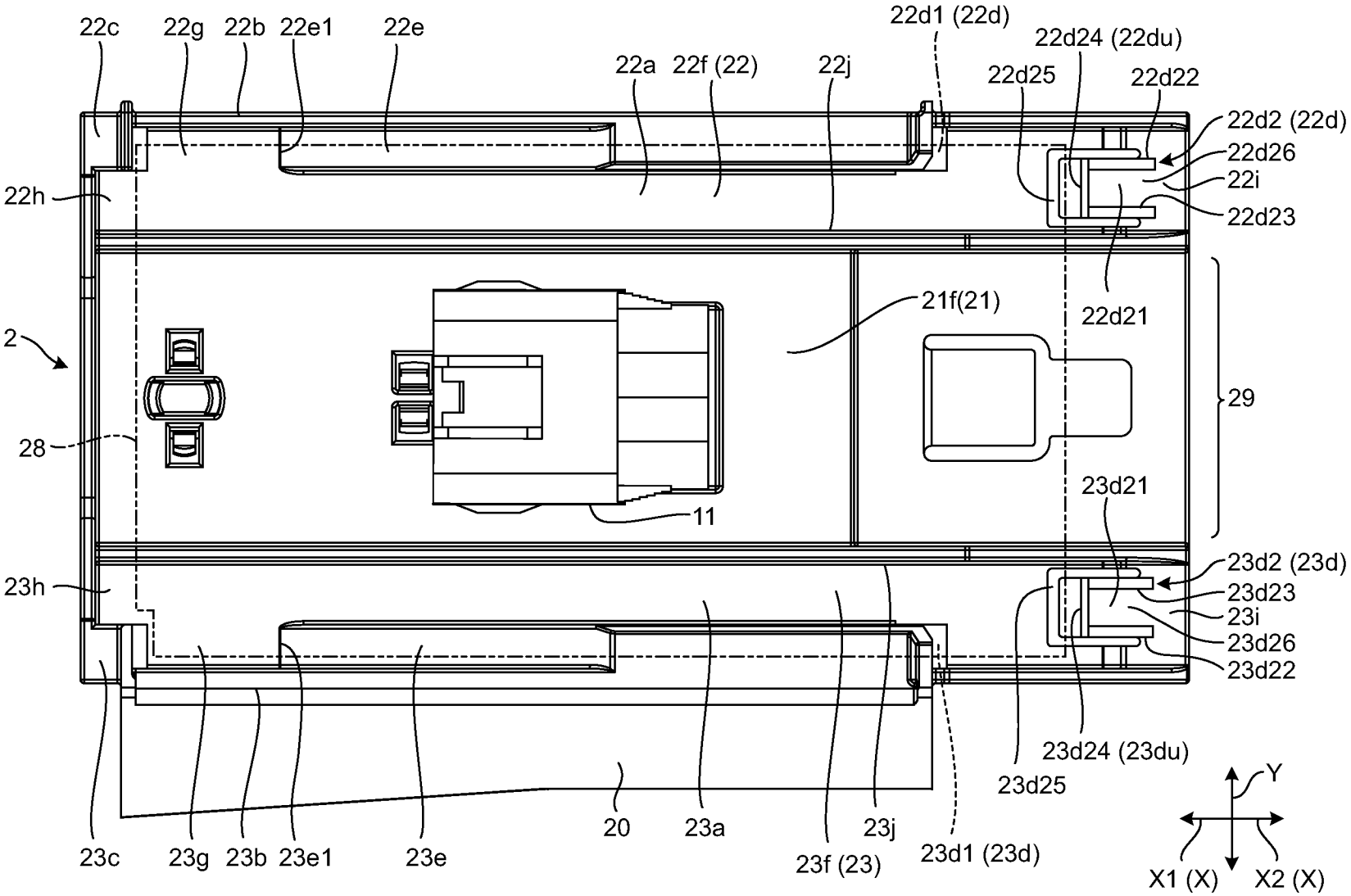
FIG. 2 is a plan view of a base member provided in the protector according to the first embodiment.
Figure 3:
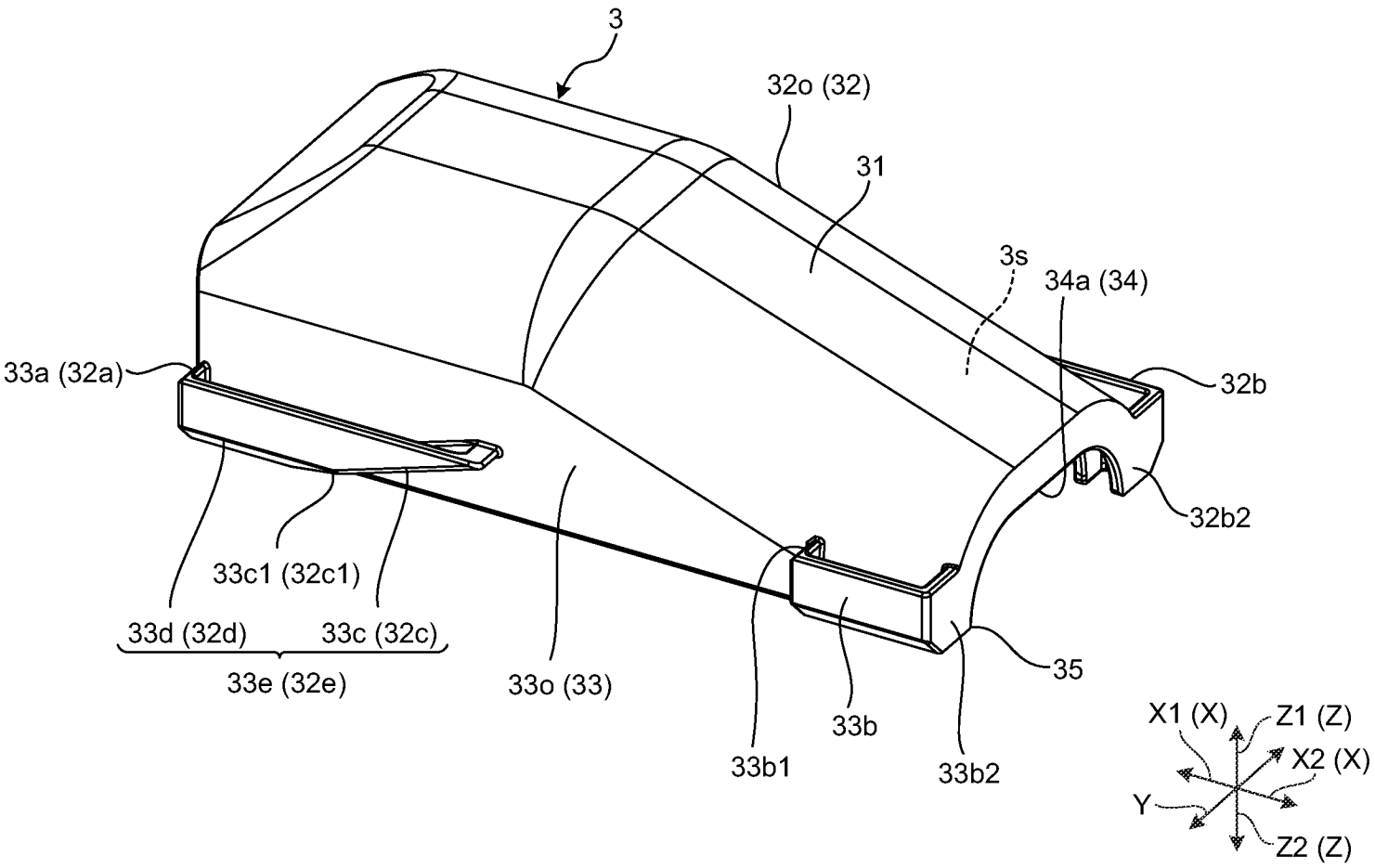
FIG. 3 is a perspective view of a cover member included in the protector according to the first embodiment.
Figure 4:
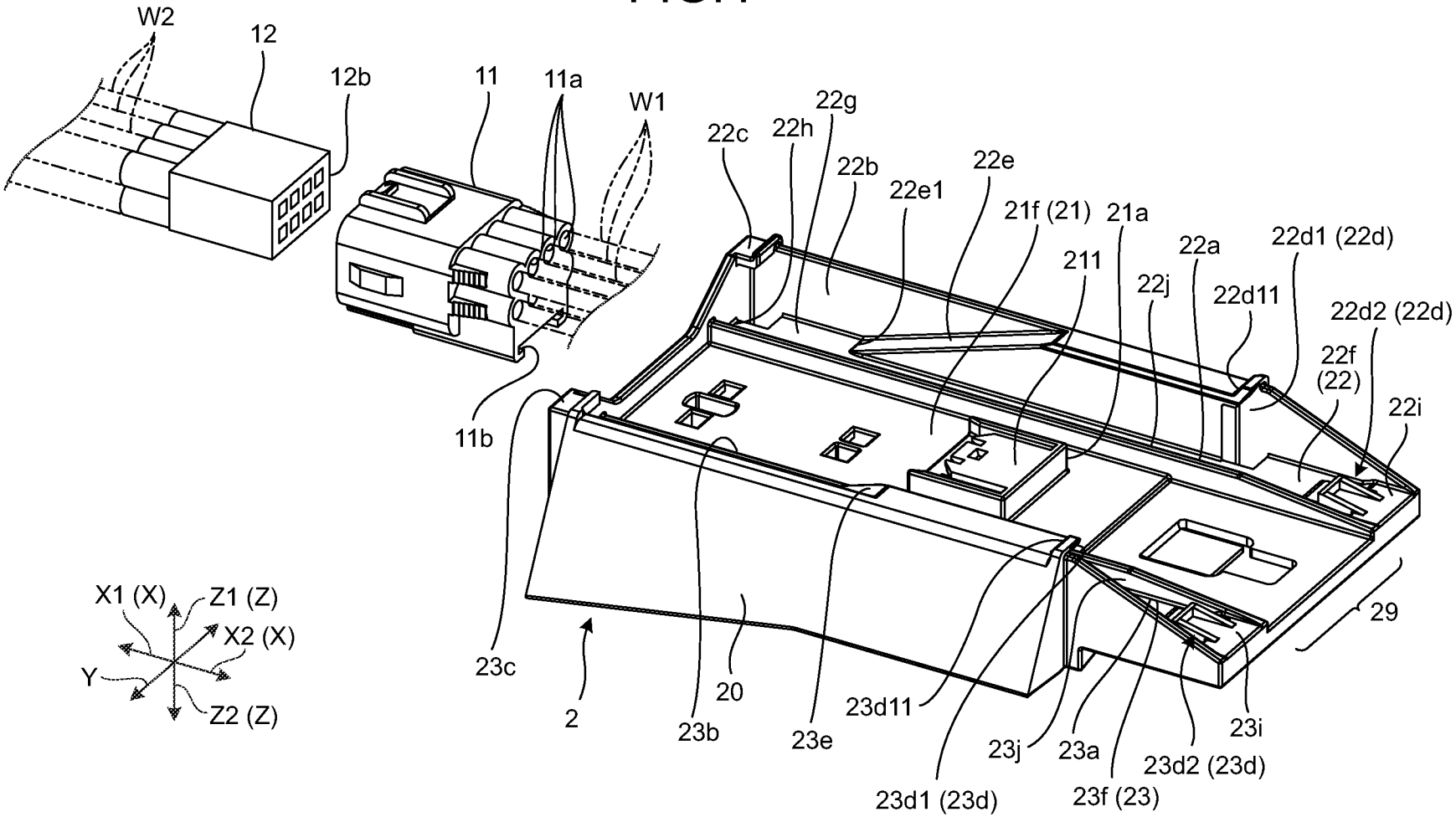
FIG. 4 is a perspective view illustrating a base member, a first connector, and a second connector of the wire harness according to the first embodiment.

FIG. 1 is a perspective view of a wire harness WH1 including a protector 1 according to a first embodiment. FIG. 2 is a plan view of a base member 2 included in the protector 1 according to the first embodiment. FIG. 3 is a perspective view of a cover member 3 included in the protector 1 according to the first embodiment. FIG. 4 is a perspective view of the base member 2, a first connector 11, and a second connector 12 of the wire harness WH1 according to the first embodiment. For convenience of description, each of the number of first wiring members W1 and the number of second wiring members W2 illustrated in FIG. 1 is four.

In the following description, reference character X1 denotes an attachment direction in the protector 1 and the wire harness WH1 according to the present embodiment. Reference character X2 denotes a detachment direction, which is an opposite direction of the attachment direction X1. Reference character X denotes an attachment/detachment direction including the attachment direction X1 and the detachment direction X2. Reference character Y denotes a width direction Y orthogonal to the attachment direction X1 and the detachment direction X2 in the protector 1 and the wire harness WH1 according to the present embodiment. Reference character Z denotes an upper/lower direction orthogonal to the attachment/detachment direction X and the width direction Y in the protector 1 and the wire harness WH1 according to the present embodiment. Reference character Z1 denotes an upper direction in the upper/lower direction Z. Reference character Z2 denotes a lower direction in the upper/lower direction Z. In the protector 1 and the wire harness WH1 according to the present embodiment, the attachment/detachment direction X, the width direction Y, and the upper/lower direction Z are orthogonal to one another.

First Embodiment

The protector 1 according to the first embodiment illustrated in FIG. 1 protects a wiring member W by being incorporated in the wire harness WH1 that is mounted in a vehicle such as an automobile. For example, in order to connect various devices mounted in the vehicle, the wire harness WH1 bundles a plurality of wiring members W used for power supply and signal communication into an assembled component, and connects the wiring members W to the devices via a connector or the like.

The wire harness WH1 according to the present embodiment includes a first wiring member W1 having a conductive first core wire Wa1, a second wiring member W2 having a conductive second core wire Wa2, the first connector 11 having a terminal of the first wiring member W1 inserted thereinto, a second connector 12 having a terminal of the second wiring member W2 inserted thereinto, and the protector 1 that protects the first wiring member W1 and the second wiring member W2 from the outside. The first wiring member W1 and the second wiring member W2 are formed by, for example, electric wires. In the electric wires, for example, the peripheries of the core wires Wa1 and Wa2, which are conductors each including a plurality of conductive metal strands, are covered with insulating coverings Wb1 and Wb2 (see FIG. 1). The wire harness WH1 may further include an electrical junction box, a grommet, a fixture, or the like. Hereinafter, the configuration of the protector 1 will be described in detail with reference to the drawings.

The first connector 11 is formed by, for instance, insulating synthetic resin. A plurality of first cavities 11*a* are formed in an upper portion in the upper/lower direction Z of the first connector 11 as illustrated in FIG. 4. The end of the first wiring member W1 is inserted into each of the first cavities 11*a*. The first connector 11 also has a connector engagement recessed portion 11*b* in a lower portion in the upper/lower direction Z. The first connector 11 further has a connector fitting recessed portion into which the second connector 12 can be inserted, at its end on the attachment direction X1 side.

The second connector 12 is formed by, for instance, insulating synthetic resin. A plurality of second cavities are formed in an upper portion in the upper/lower direction Z of the second connector 12. The end of the second wiring member W2 is inserted into each of the second cavities. The second connector 12 also has a connector fitting projecting portion 12*b* to be inserted into the connector fitting recessed portion of the first connector 11, at its end on the detachment direction X2 side.

The protector 1 is formed by an insulating synthetic resin material, and is disposed at, for example, the back side of the passenger's feet in the back seat of the vehicle. The protector 1 according to the present embodiment includes the base member 2 and a cover member 3 attached to the base member 2.

The base member 2 includes, when viewed from the upper/lower direction Z, a base body 21 located in the center of the width direction Y and a pair of base bilateral-side portions 22 and 23 located on both sides of the width direction Y, as illustrated in FIG. 2. The protector 1 according to the present embodiment has a base side cover 20 that covers the outside of the width direction Y in one of the base bilateral-side portions 22 and 23 out of the pair of base bilateral-side portions 22 and 23. More specifically, the protector 1 has the base side cover 20 that covers the outside of the width direction Y in the one base side 23 out of the pair of base bilateral-side portions 22 and 23.

The base body 21, as illustrated in FIGS. 2 and 4, is formed in a rectangular planar shape having a base body upper surface 21*f* orthogonal to the upper/lower direction Z, and a connector attachment portion 21*a* to which the first connector 11 is attached is provided on the base body upper surface 21*f* side. The connector attachment portion 21*a* is provided in the center in the width direction Y of the base body 21. The connector attachment portion 21*a* is provided with a connector claw 211 that engages with the connector engagement recessed portion 11*b* of the first connector 11.

The protector 1 according to the present embodiment is formed in line symmetry with respect to a center line located in the center in the width direction Y and extending along the attachment/detachment direction X. Thus, in the following description, the configuration of one side in the width direction Y will be described, while the description of the configuration of the other side in the width direction Y is omitted by enclosing the reference characters in parentheses.

The base bilateral-side portion 22 (23) has a base bilateral side base portion 22*a* (22*b*) having a base bilateral side plane 22*f* (23*f*) that constitute the same plane as the base body upper surface 21*f* of the base body 21.

The pair of base bilateral-side portions 22 (23) have a pair of first facing walls (pair of facing walls) 22*b* and 23*b* and a pair of second facing walls 22*j* and 23*j*, which face each other in the width direction Y.

The first facing wall 22*b* (23*b*) extends along the attachment/detachment direction X and is arranged linearly. The pair of first facing walls 22*b* and 23*b* are then arranged in parallel. The first facing wall 22*b* (23*b*) is correspondingly located outside the width direction Y in the base bilateral-side portion 22 (23). Moreover, a width between the pair of first facing walls 22*b* and 23*b* in the width direction Y is slightly larger than a width in the width direction Y of the cover member 3. Therefore, the cover member 3 according to the present embodiment is disposed between the pair of first facing walls 22*b* and 23*b* in the width direction Y in the state of being disposed in an attachment position 28, and a cover bilateral-side portions 32 and 33 and the first facing walls 22*b* and 23*b* respectively face each other in the width direction Y, and the movement of the cover member 3 in the width direction Y is restricted.

The second facing wall 22*j* (23*j*) extends along the attachment/detachment direction X and is arranged linearly. The pair of second facing walls 22*j* and 23*j* are then arranged in parallel. The second facing wall 22*j* (23*j*) is disposed inside the width direction Y and adjacent to the base body 21 in the width direction Y.

The base bilateral-side portion 22 (23) includes a pair of hooking portions 22*c* (23*c*), a pair of locking parts 22*d* (23*d*), a pair of inclined guides 22*e* (23*e*), and a pair of horizontal guides 22*g* (23*g*).

Figure 5:
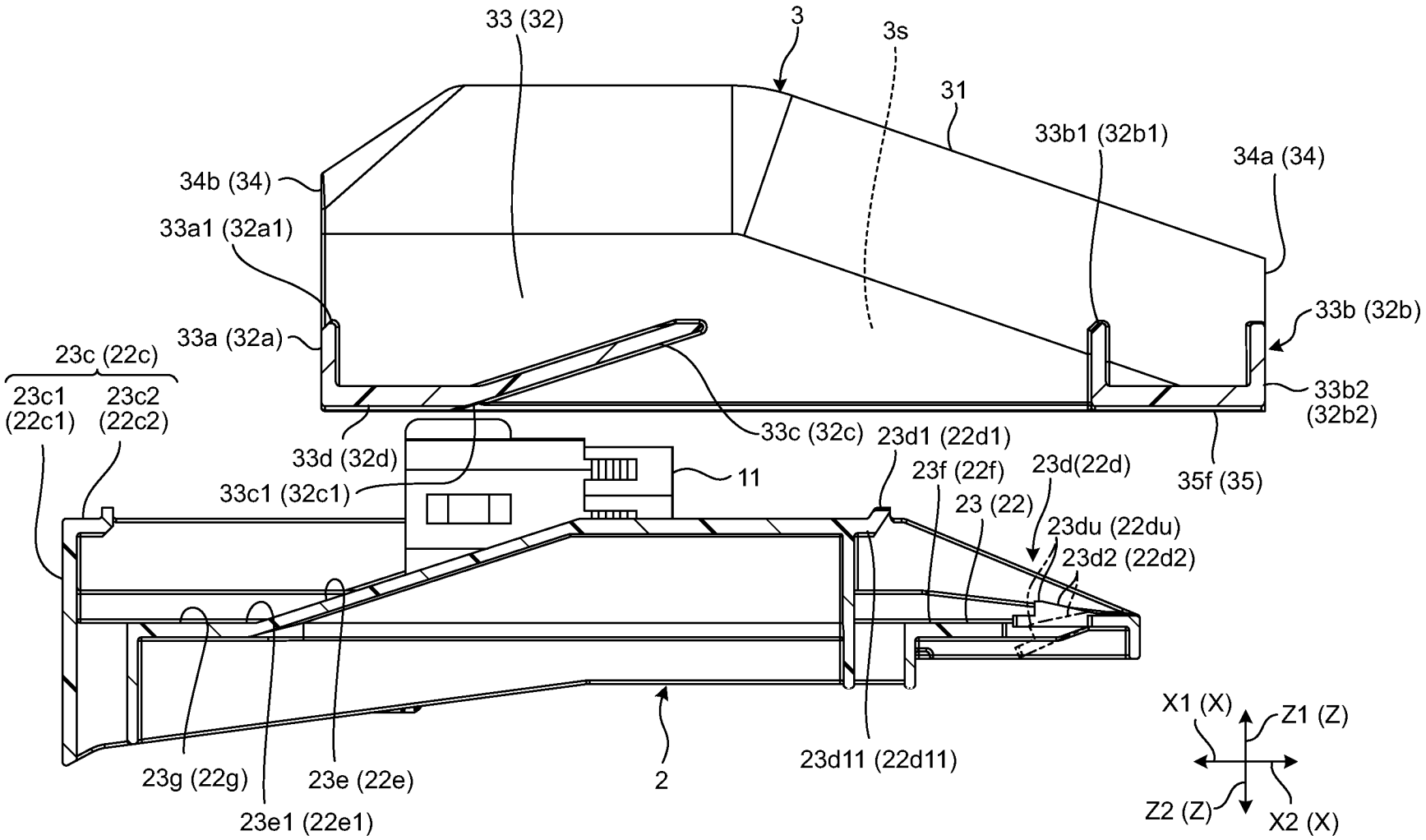
FIG. 5 is a longitudinal cross-sectional view describing assembly of the wire harness in order in an assembly process of the wire harness according to the first embodiment.

The hooking portion 22*c* (23*c*) is provided on an attachment direction-side end 22*h* (23*h*) on the base bilateral-side portion 22 (23) in the attachment direction X1. The hooking portion 22*c* (23*c*) includes, as illustrated in FIG. 5, a hooking base 22*c*1 (23*c*1) extending in the upper direction Z1 in the upper/lower direction Z from the base bilateral side plane 22*f* (23*f*), and a hooking facing part 22*c*2 (23*c*2) extending from the upper end of the hooking base 22*c*1 (23*c*1) to the detachment direction X2 side.

A pair of inclined guides 22*e* (23*e*) are provided, on the base bilateral-side portion 22 (23), on the detachment direction X2 side of the hooking portion 22*c* (23*c*), and go in the lower direction Z2 as going in the attachment direction X1. The inclined guide 22*e* (23*e*) in the present embodiment is formed of a flat surface that is inclined at a certain angle with respect to the attachment direction X1.

A pair of horizontal guides 22*g* (23*g*) are provided between the inclined guide 22*e* (23*e*) and the hooking portions 22*c* (23*c*) in the attachment direction X1 of the base bilateral-side portion 22 (23), and extend along the attachment direction X1 from the attachment direction-side end 22*e*1 (23*e*1) in the inclined guide 22*e* (23*e*). The horizontal guide 22*g* (23*g*) in the present embodiment is formed of a flat surface parallel to the attachment direction X1.

A pair of locking parts 22*d* (23*d*) are provided, on the base bilateral-side portion 22 (23), in the detachment direction X2 side of the inclined guide 22*e* (23*e*). The locking part 22*d* (23*d*) correspondingly includes a first locking part 22*d*1 (23*d*1) located at the attachment direction-side end in the locking part 22*d* (23*d*) and a second locking part 22*d*2 (23*d*2) located at the detachment direction-side end.

The first locking part 22*d*1 (23*d*1) is formed by a plurality of plate-like parts and is a recessed portion that is recessed toward the attachment direction X1, as illustrated in FIG. 5. The first locking part 22*d*1 (23*d*1) has a first locking upper end facing part 22*d*11 (23*d*11) that faces a locked upper end 32*b*1 (33*b*1) in the locked part 33*b* (32*b*) in the upper/lower direction Z with the cover member 3 moved to the attachment position 28. In other words, the first locking part 22*d*1 (23*d*1) is a recessed portion having a bottom wall on the attachment direction X1 side, an opening on the detachment direction X2 side, and first facing walls 22*b* and 23*b* located outside the width direction Y, each serving as a side wall.

The second locking part 22*d*2 (23*d*2) is formed to be elastically deformable in the upper/lower direction Z. The second locking part 22*d*2 (23*d*2), until the cover member 3 moves to the attachment position 28, is in the retreating state of retreating in the lower direction Z2 by coming into contact with the locked part 33*b* (32*b*) in the upper/lower direction Z, whereas, when the cover member 3 moves to the attachment position 28, the second locking part 22*d*2 (23*d*2) is in the advancing state of advancing in the upper direction Z1 by not coming into contact with the locked part 33*b* (32*b*) in the upper/lower direction Z, and faces the detachment direction-side end of the locked part 33*b* (32*b*) in the detachment direction X2.

The second locking part 22*d*2 (23*d*2) has a lock base 22*d*21 (23*d*21), a pair of lock facing walls 22*d*22 and 22*d*23 (23*d*22 and 23*d*23), and a lock coupling wall 22*d*24 (23*d*24).

The lock base 22*d*21 (23*d*21) is formed in a rectangular planar shape. The pair of lock facing walls 22*d*22 and 22*d*23 (23*d*22 and 23*d*23) are provided on an upper surface of the lock base 22*d*21 (23*d*21). Out of the pair of lock facing walls 22*d*22 and 22*d*23 (23*d*22 and 23*d*23), one lock facing wall 22*d*22 (23*d*22) and the other lock facing wall 22*d*22 (23*d*22) face each other in the width direction Y. Each of the lock facing walls 22*d*22 and 22*d*23 (23*d*22 and 23*d*23) is formed in a triangular shape, the height of which is greatest on the attachment direction X1 side, and is gradually reduced toward the detachment direction X2. The lock coupling wall 22*d*24 (23*d*24) couples an end on the attachment direction X1 side of each of the lock facing walls 22*d*22 and 22*d*23 (23*d*22 and 23*d*23) together. An upper end 22*du* (23*du*) of the lock coupling wall 22*d*24 (23*d*24) is located at the uppermost upper direction Z1 side of the second locking part 22*d*2 (23*d*2).

In the second locking part 22*d*2 (23*d*2), a cutout 22*d*25 (23*d*25) is disposed on three sides out of the four sides, and a lock coupled part 22*d*26 (23*d*26) coupled to the base bilateral side base portion 22*a* (23*a*) is provided on the remaining one side as viewed from the upper/lower direction Z. More specifically, the lock coupled part 22*d*26 (23*d*26) coupled to the base bilateral side base portion 22*a* (23*a*) is provided on the detachment direction X2 side as viewed from the upper/lower direction Z. Meanwhile, the cutout 22*d*25 (23*d*25) is provided on the attachment direction X1 side and the bilateral sides in the width direction Y as viewed from the upper/lower direction Z. The second locking part 22*d*2 (23*d*2) is provided in the base bilateral side base portion 22*a* (23*a*) as described above, so that the lock coupled part 22*d*26 (23*d*26) is elastically deformed, and the second locking part 22*d*2 (23*d*2) is deformed into an advancing state (indicated by a solid line in FIG. 5) in which the upper end 22*du* (23*du*) advances upward and into a retreating state (indicated by a virtual line in FIG. 5) in which the upper end 22*du* (23*du*) retreats downward from the advancing state.

As illustrated in FIGS. 5 and 3, the cover member 3 is formed in a gutter shape opened at both ends in the attachment/detachment direction X and at one end in the upper/lower direction Z (a lower end in the upper/lower direction Z), and has an accommodating space 3*s*. The cover member 3 is then attached to the base member 2 when disposed in the attachment position 28. In the protector 1 according to the present embodiment, the first connector 11, the second connector 12, the first wiring member W1, and the second wiring member W2 are accommodated in the accommodating space 3*s* of the cover member 3 when the cover member 3 is disposed at the attachment position 28. That is, in the protector 1, the first connector 11, the second connector 12, the first wiring member W1, and the second wiring member W2 are accommodated in the accommodating space 3*s* of the cover member 3.

The cover member 3 includes a cover body 31 located in the center of the width direction Y and cover bilateral-side portions 32 and 33 located on both sides in the width direction Y. The cover bilateral-side portions 32 and 33 face each other in the width direction Y.

The cover body 31 includes a cover through opening 34 that communicates with the accommodating space 3*s* at both ends in the attachment/detachment direction X, and a cover opening/closing opening (cover opening) 35 that communicates with the accommodating space 3*s* and is located in the center of the width direction Y at one end in the upper/lower direction Z (more specifically, the lower end in the upper/lower direction Z). In other words, the cover member 3 includes the accommodating space 3*s*, and the cover body 31 that communicates with the accommodating space 3*s* and has the cover opening 35 located in the center of the width direction Y.

The cover through opening 34 is an opening through which the first wiring member W1 and the second wiring member W2 are inserted into the accommodating space 3*s* from the outside. The cover through opening 34 has a first cover through opening 34*a* through which the first wiring member W1 is inserted at the detachment direction-side end of the cover member 3, and a second cover through opening 34*b* through which the second wiring member W2 is inserted at the attachment direction-side end of the cover member 3. That is, the cover member 3 includes the first cover through opening 34*a* through which the first wiring member W1 is inserted at the detachment direction-side end, and the second cover through opening 34*b* through which the second wiring member W2 is inserted at the attachment direction-side end. The first cover through opening 34*a* and the second cover through opening 34*b* are opened along the width direction Y and the upper/lower direction Z.

The cover opening/closing opening 35 illustrated in FIG. 4 is an opening for opening the accommodating space 3*s* to the outside, and closed by the base member 2. The cover opening/closing opening 35 according to the present embodiment is closed by the base member 2 after attaching the first connector 11 to the base member 2, and fitting the second connector 12 to the first connector 11. The cover opening/closing opening 35 is located at one end in the upper/lower direction Z (the lower end in the upper/lower direction Z) of the base member 2, and is formed opposite to the side where the cover body 31 is formed in the upper/lower direction Z.

The cover bilateral-side portion 32 (33) includes a hooked portion 32*a* (33*a*), a locked part 32*b* (33*b*), and a guided part 32*e* (33*e*). The hooked portion 32*a* (33*a*), the locked part 32*b* (33*b*), an inclined guided part 32*c* (33*c*), and the guided part 32*e* (33*e*) are formed by protruding from an outer surface 32*o* (33*o*) of the corresponding cover bilateral surface.

The hooked portion 32*a* (33*a*) is provided at the attachment direction-side end in the cover bilateral-side portion 32 (33), and is hooked on the hooking portion 22*c* (23*c*) in a state in which the cover member 3 is moved to the attachment position 28. The hooked portion 32*a* (33*a*) has a hooked upper end 32*a*1 (33*a*1) at its upper end in the upper/lower direction Z.

The pair of guided parts 32*e* (33*e*) are provided on the detachment direction X2 side of the hooked portion 33*a* (32*a*) in the cover bilateral-side portion 32 (33), and come into contact with at least one of the inclined guide 22*e* (23*e*)

and the horizontal guide 22g (23g). The guided part 32e (33e) according to the present embodiment includes the inclined guided part 32c (33c) and a horizontal guided part 32d (33d).

The pair of inclined guided parts 32c (33c) are provided at the detachment direction-side end in the guided part 32e (33e), and come into contact with the inclined guide 22e (23e) before the cover member 3 is moved to the attachment position 28. The inclined guided part 32c (33c) according to the present embodiment is formed of a flat surface that is inclined at a certain angle with respect to the attachment direction X1.

The pair of horizontal guided parts 32d (33d) are provided at the attachment direction-side end in the guided part 32e (33e), and extend from the attachment direction-side end 32c1 (33c1) in the inclined guided part 32c (33c) toward the attachment direction X1 side, and come into contact with the horizontal guide 22g (23g) before the cover member 3 moves to the attachment position 28. The horizontal guided part 32d (33d) according to the present embodiment is formed a flat surface parallel to the attachment direction X1.

In the cover member 3 according to the present embodiment, the outer end of the width direction Y in the hooked portion 33b (32b), the outer end of the width direction Y in the inclined guided part 32c (33c), and the outer end of the width direction Y in the horizontal guided part 32d (33d) are connected by a plate-like part, and rigidity is improved by the plate-like part.

A pair of the locked parts 32b (33b) are provided on the detachment direction X2 side of the guided part 32e (33e) in the cover bilateral-side portion 32 (33), and are locked to the locking part 22d (23d) in a state in which the cover member 3 is moved to the attachment position 28. The locked part 33b (32b) is formed, for example, in a gutter shape extending along the attachment/detachment direction X, and has a first locked part 33b1 (32b1) and a second locked part 33b2 (32b2).

The first locked part 33b1 (32b1) is formed in a planar shape orthogonal to the attachment/detachment direction X, and is disposed at the attachment direction-side end in the locked part 33b (32b).

The second locked part 33b2 (32b2) is formed in a planar shape orthogonal to the attachment/detachment direction X, and is disposed at the detachment direction-side end in the locked part 33b (32b).

The locked part 33b (32b) according to the present embodiment allows the lower end of the first locked part 33b1 (32b1) and the lower end of the second locked part 33b2 (32b2) to be connected by a flat plate-like part, thereby improving its rigidity.

Figure 8:
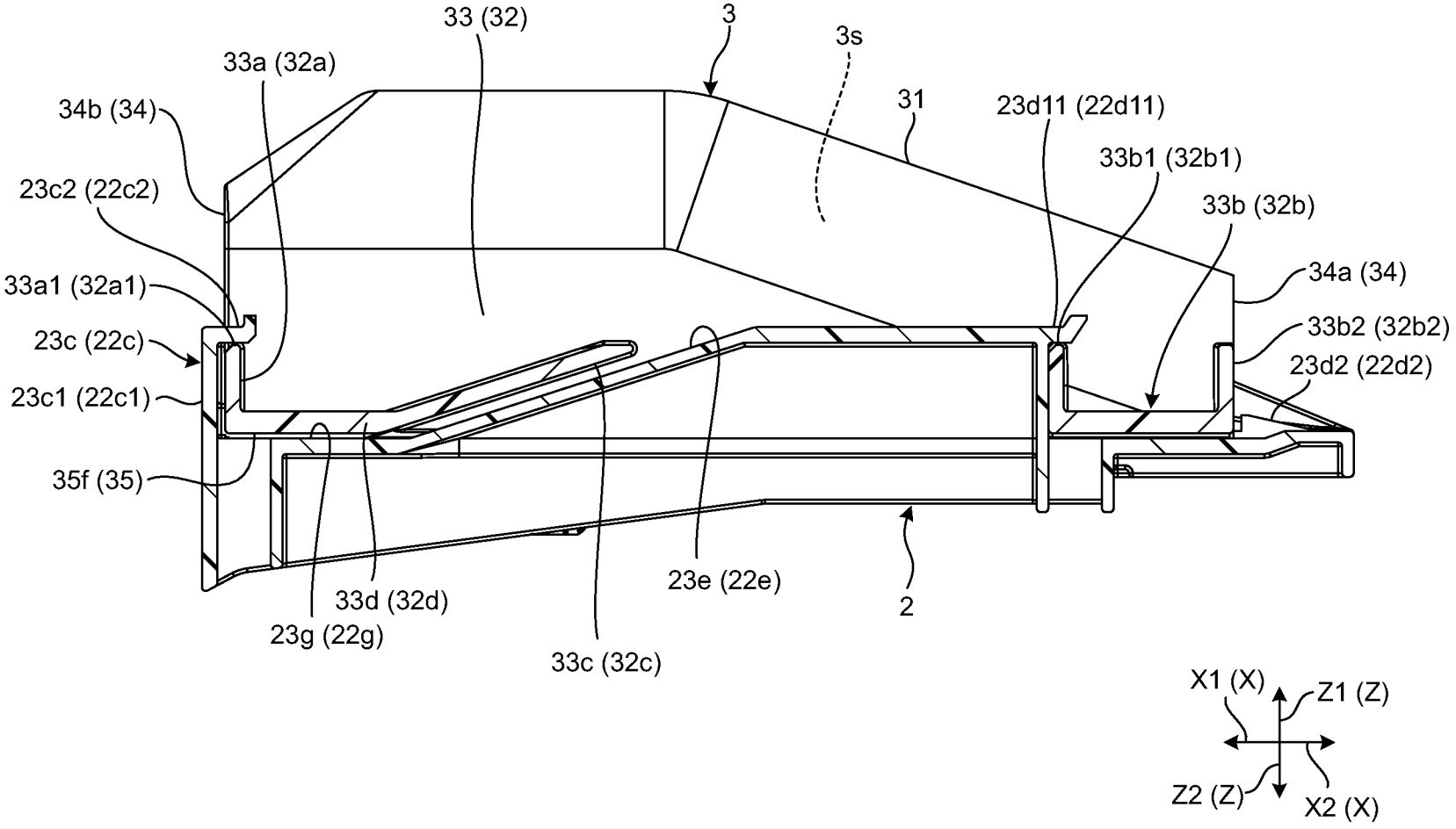
FIG. 8 is a longitudinal cross-sectional view describing the assembly of the wire harness in order in the assembly process of the wire harness according to the first embodiment.

In a state in which the cover member 3 is disposed in the attachment position 28, the second locking part 22d2 (23d2) in the advancing state faces the second locked part 33b2 (32b2) of the locked part 33b (32b) in the detachment direction X2, as illustrated in FIG. 8. In the detachment direction X2, the second locking part 22d2 (23d2) faces the second locked part 33b2 (32b2), thereby restricting movement of the cover member 3 toward the detachment direction X2.

In the state in which the cover member 3 is disposed in the attachment position 28, the first locking upper end facing part 22d11 (23d11) of the first locking part 22d1 (23d1) faces the locked upper end 32b1 (33b1) in the locked part 33b (32b). In the upper direction Z1, the first locking part 22d1 (23d1) faces the first locked part 33b1 (32b1), thereby restricting the movement of the cover member 3 toward the upper direction Z1 side.

Next, the attachment method for the wire harness WH1 according to the present embodiment will be described. First, an operator disposes the first wiring member W1 along the detachment direction X2, and attaches the first connector 11 to the connector attachment portion 21a of the base member 2.

The operator then disposes the second wiring member W2 along the attachment direction X1, and fits the second connector 12 to the first connector 11. That is, the operator disposes the second wiring member W2 along the attachment direction X1, and fits the second connector 12 to the first connector 11. In a state in which the second connector 12 is fitted to the first connector 11, the base member 2 has a wiring region 29 formed on the upper surface of the base body 21, in which the first wiring member W1 and the second wiring member W2 are disposed.

Subsequently, the operator attaches the base member 2 to a vehicle body.

Next, as illustrated in FIG. 5, the operator disposes the cover member 3 in the upper direction Z1 in the upper/lower direction Z of the base member 2. In this case, the cover member 3 is in a horizontal state by making the position of the upper/lower direction Z of the attachment direction-side end of the cover member 3 match with the position of the upper/lower direction Z of the detachment direction-side end of the cover member 3. When the cover member 3 is disposed in the horizontal state, an aperture 35f of the cover opening 35 is parallel to a horizontal plane including the attachment/detachment direction X and the width direction Y.

Figure 6:
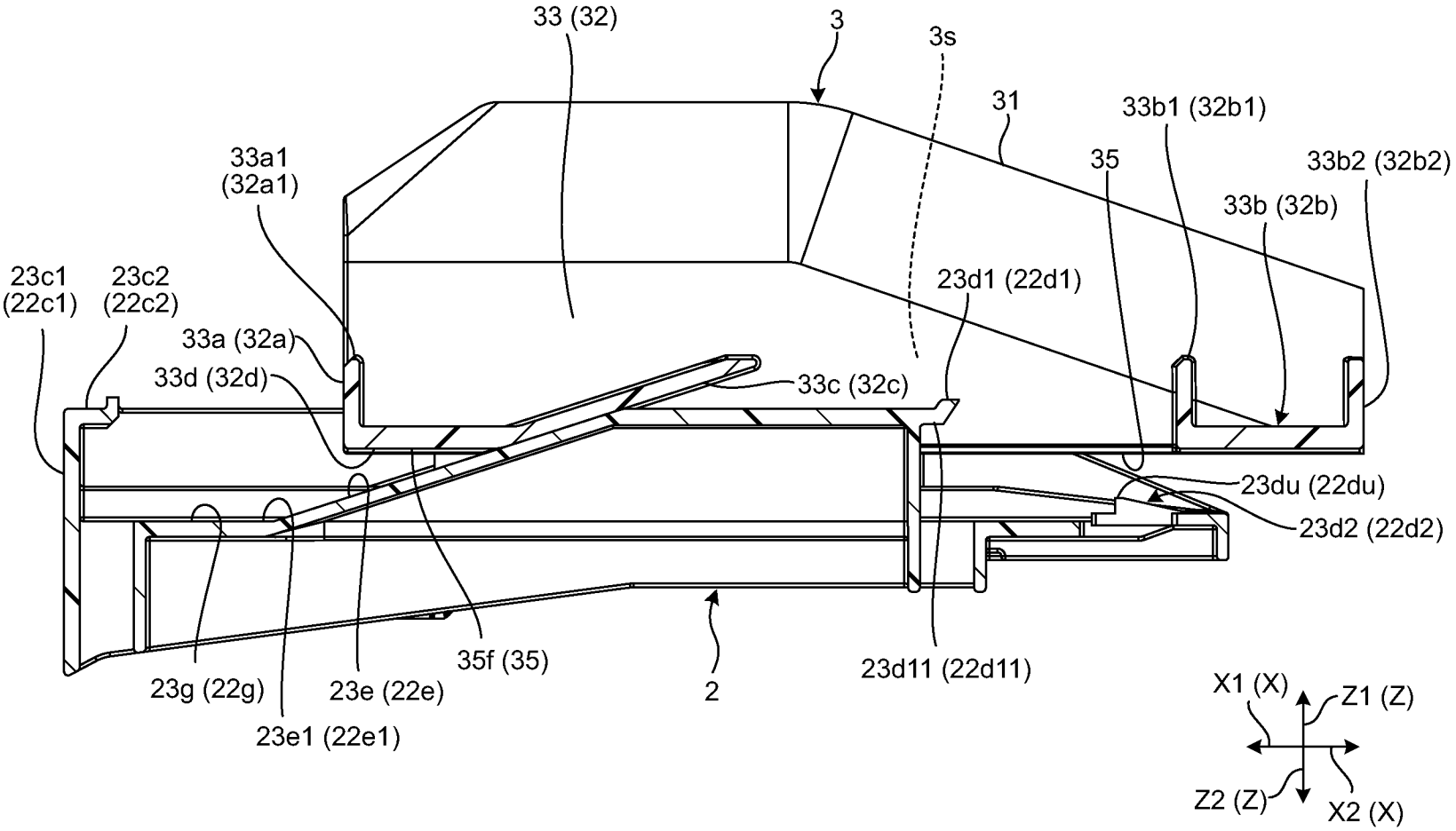
FIG. 6 is a longitudinal cross-sectional view describing the assembly of the wire harness in order in the assembly process of the wire harness according to the first embodiment.

Next, the operator moves the cover member 3 in the lower direction Z2 to bring the inclined guided part 32c (33c) of the cover member 3 contact into the inclined guide 22e (23e) of the base member 2, as illustrated in FIG. 6.

Next, the operator performs an inclined direction guiding operation to move the cover member 3 in the lower direction Z2 with the inclined guided part 32c (33c) in contact with the inclined guide 22e (23e). When the inclined direction guiding operation is performed, the cover member 3 goes in the attachment direction X1 as going in the lower direction Z2.

Then, during the inclined direction guiding operation, the locked part 32b (33b) of the cover member 3 comes into contact with the upper end 22du (23du) of the second locking part 22d2 (23d2), and the second locking part 22d2 (23d2), which has been in the advancing state, enters the retreating state.

Figure 7:
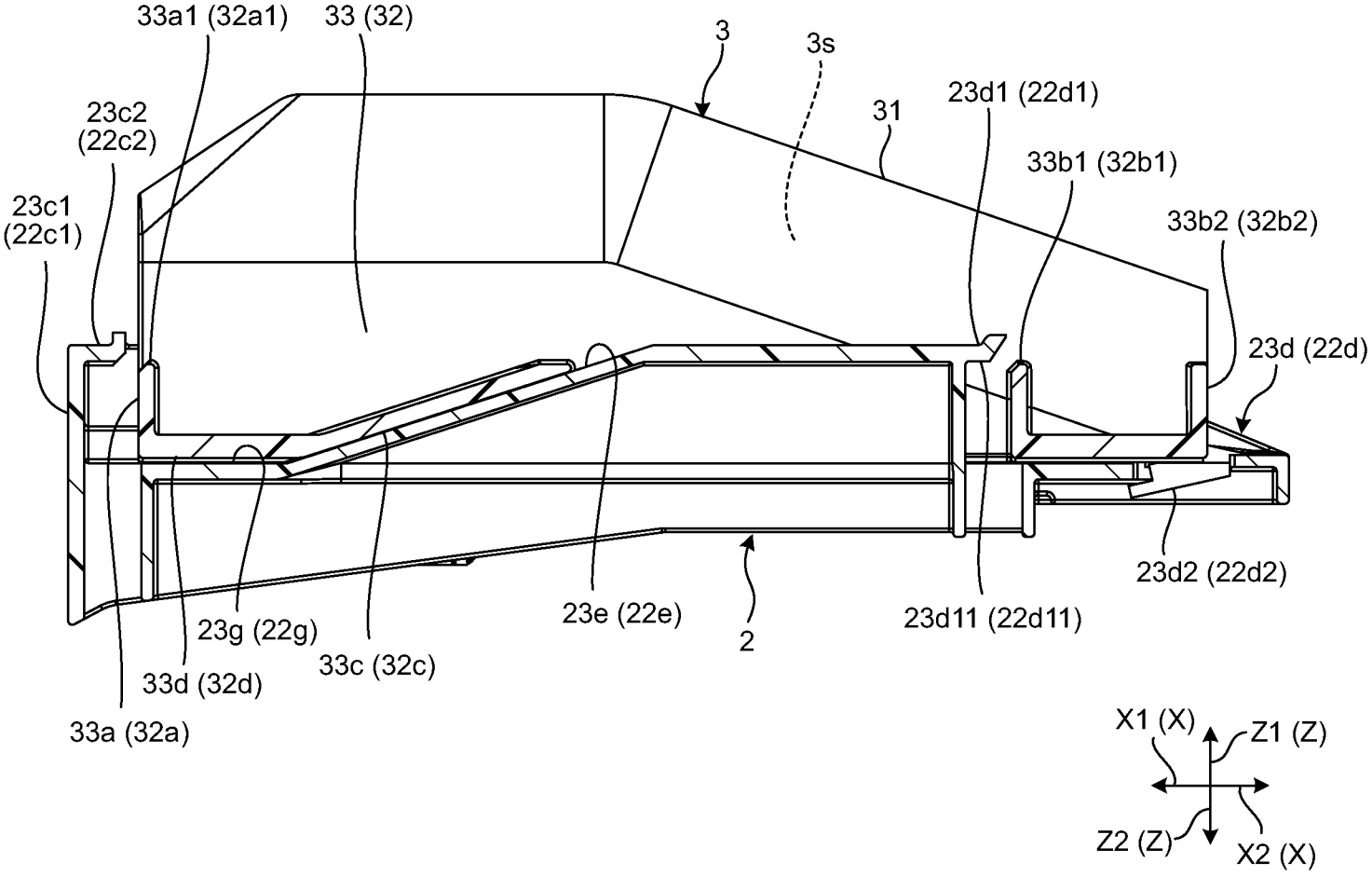
FIG. 7 is a longitudinal cross-sectional view describing the assembly of the wire harness in order in the assembly process of the wire harness according to the first embodiment.

Next, the operator moves the guided part 32e (33e) from the inclined guide 22e (23e) to the horizontal guide 22g (23g), as illustrated in FIG. 7, while maintaining the contact state in which the inclined guided part 32c (33c) is in contact with the base member 2, and performs a horizontal guiding operation in which the cover member 3 is moved to the attachment direction X1 with the horizontal guided part 32d (33d) in contact with the horizontal guide 22g (23g).

Then, as illustrated in FIG. 8, when the cover member 3 is moved to the preset attachment position 28, the protector 1 is in a movement restricted state in which the cover opening 35 is closed by the base member 2, the hooking portion 22c (23c) is hooked on the hooked portion 32a (33a), and the locking part 22d (23d) is locked on the locked part 32b (33b).

When the protector 1 is in the movement restricted state, the hooking portion 22c (23c) of the base member 2 faces the hooked portion 32a (33a) of the cover member 3 in the attachment direction X1, and the movement of the cover member 3 in the attachment direction X1 with respect to the base member 2 is restricted.

In the protector 1, until the cover member 3 is moved to the attachment position 28, in the upper/lower direction Z, the locked part 32*b* (33*b*) of the cover member 3 comes into contact with the upper end 22*du* (23*du*) of the second locking part 22*d*2 (23*d*2), whereby the second locking part 22*d*2 (23*d*2) is in the retreating state. On the other hand, when the protector 1 is in the movement restricted state in which the cover member 3 is moved to the attachment position 28, in the upper/lower direction Z, the locked part 32*b* (33*b*) of the cover member 3 does not come into contact with the upper end 22*du* (23*du*) of the second locking part 22*d*2 (23*d*2), and the second locking part 22*d*2 (23*d*2) is in the advancing state. Then, in the protector 1, when the second locking part 22*d*2 (23*d*2) is in the advancing state, in the detachment direction X2, the second locking part 22*d*2 (23*d*2) faces the second locked part 33*b*2 (32*b*2) of the locked part 32*b* (33*b*), and the movement of the cover member 3 in the detachment direction X2 with respect to the base member 2 is restricted.

Furthermore, when the protector 1 is in the upper/lower direction Z in the movement restricted state, the hooking facing part 22*c*2 (23*c*2) of the hooking portion 22*c* (23*c*) faces the hooked upper end 32*a*1 (33*a*1) of the hooked portion 32*a* (33*a*). Besides, when the protector 1 is in the upper/lower direction Z in the movement restricted state, the first locking upper end facing part 22*d*11 (23*d*11) of the first locking part 22*d*1 (23*d*1) faces the first locked part 32*b*1 (33*b*1). By these means, in the protector 1, the movement of the cover member 3 in the upper/lower direction Z with respect to the base member 2 is restricted.

Besides, in the protector 1, the cover bilateral-side portions 32 and 33 and the first facing walls 22*b* and 23*b* face each other in the width direction Y in the movement restricted state. As a result, in the protector 1, the movement of the cover member 3 in the width direction Y is restricted with respect to the base member 2.

The protector 1 according to the present embodiment has the following configuration. The base bilateral-side portions 22 and 23 of the base member 2 include hooking portions 22*c* and 23*c* provided at the attachment direction-side end, a pair of the inclined guides 22*e* and 23*e* that are provided on the detachment direction X2 side of the hooking portions 22*c* and 23*c* and go in the lower direction Z2 as going in the attachment direction X1, a pair of the horizontal guides 22*g* and 23*g* extending along the attachment direction X1 from the attachment direction-side end in the inclined guides 22*e* and 23*e*, and a pair of the locking parts 22*d* and 23*d* provided on the detachment direction X2 side of the inclined guides 22*e* and 23*e*. The cover bilateral-side portions 32 and 33 of the cover member 3 are provided at the attachment direction-side end, and include the hooked portions 32*a* and 33*a* to be hooked on the hooking portions 22*c* and 23*c*, a pair of the guided parts 32*e* and 33*e* to be provided on the detachment direction X2 side of the hooked portions 32*a* and 33*a* and come into contact with at least one of the inclined guides 22*e* and 23*e* and the horizontal guides 22*g* and 23*g*, and a pair of the locked parts 32*b* and 33*b* that are provided on the detachment direction X2 side of the guided parts 32*e* and 33*e* and locked by the locking parts 22*d* and 23*d*. For those reasons, the protector 1 according to the present embodiment performs an inclined direction guiding operation, in which, when the cover member 3 is moved in the lower direction Z2 with the guided parts 32*e* and 33*e* in contact with the inclined guides 22*e* and 23*e*, the cover member 3 goes in the attachment direction X1 as going in the lower direction Z2. Then, while a contact state is maintained in which the guided parts 32*e* and 33*e* come into contact with the base member 2, a horizontal direction guiding operation is performed in which the guided parts 32*e* and 33*e* are moved from the inclined guides 22*e* and 23*e* to the horizontal guides 22*g* and 23*g*, and the cover member 3 is moved in the attachment direction X1 with the guided parts 32*e* and 33*e* in contact with the horizontal guides 22*g* and 23*g*. When the cover member 3 is moved to the preset attachment position 28, a movement restricted state is provided in which the cover opening 35 is closed by the base member 2, and the hooking portions 22*c* and 23*c* are hooked on the hooked portions 32*a* and 33*a*, and the locking parts 22*d* and 23*d* are locked on the locked parts 32*b* and 33*b*. In the movement restricted state, the movement of the cover member 3 with respect to the base member 2 is restricted in the attachment direction X1, the detachment direction X2, and the upper/lower direction Z. In other words, the protector 1 according to the present embodiment can simultaneously provide when the cover member 3 is moved to the attachment position 28, the locking of the cover member 3 to the base member 2, and the closing of the cover opening 35. As a result, the protector 1 according to the present embodiment can facilitate the attachment operation of attaching the cover member 3 to the base member 2. Moreover, the protector 1 according to the present embodiment can bring the guided parts 32*e* and 33*e* of the cover member 3 into contact with the inclined guides 22*e* and 23*e* of the base member 2 without moving the cover member 3 assuming a narrow range in the base member 2 as a target, thereby facilitating start of the attachment work of the cover member 3 to the base member 2. As a result, the protector 1 according to the present embodiment can further facilitate the attachment operation of attaching the cover member 3 to the base member 2.

The protector 1 according to the present embodiment has the following configuration. The second locking parts 22*d*2 and 23*d*2 are each formed to be elastically deformable in the upper/lower direction Z, and until the cover member 3 is moved to the attachment position 28, the second locking parts 22*d*2 and 23*d*2 are in the retreating state of retreating in the lower direction Z2 by coming into contact with the locked parts 32*b* and 33*b* in the upper/lower direction Z, whereas when the cover member 3 moves to the attachment position 28, the second locking parts 22*d*2 and 23*d*2 are in the advancing state of advancing upward by not coming into contact with the locked parts 32*b* and 33*b* in the upper/lower direction Z, and face the detachment direction-side end in the locked parts 32*b* and 33*b* in the detachment direction X2. Therefore, according to the protector 1 according to the present embodiment, in the middle of the attachment operation in which the cover member 3 is guided toward the attachment position 28, in the detachment direction X2, the second locking parts 22*d*2 and 23*d*2 face the detachment direction-side ends of the locked parts 32*b* and 33*b*. As a result, the protector 1 according to the present embodiment can improve the attachment operation of the cover member 3 to the base member 2.

The protector 1 according to the present embodiment has the following configuration. The base member 2 has a pair of first facing walls 22*b* and 23*b* facing each other in the width direction Y, and the cover member 3 is disposed between the pair of first facing walls 22*b* and 23*b* in the width direction Y. Moreover, according to the protector 1 according to the present embodiment, the pair of first facing walls 22*b* and 23*b* facing each other in the width direction Y can restrict the movement of the cover member 3 in the width direction Y with respect to the base member 2.

The wire harness WH1 according to the present embodiment has the following configuration. The base member 2 includes the base body 21 provided with the first connector 11 and located in the center in the width direction Y, and the base bilateral-side portions 22 and 23 provided with the respective inclined guides 22*e* and 23*e*, respective hooking portions 22*c* and 23*c*, and respective locking parts 22*d* and 23*d*, and located on both sides in the width direction Y with respect to the base body. The first wiring member W1 is disposed on the base body 21 along the detachment direction X2, and the second wiring member W2 is disposed on the base body 21 along the attachment direction X1. In the width direction Y in a state in which the second connector 12 is fitted to the first connector 11, between the pair of inclined guides 22*e* and 23*e*, between the pair of hooking portions 22*c* and 23*c*, and the pair of locking parts 22*d* and 23*d*, the wiring region 29 is formed in which the first wiring member W1 and the second wiring member W2 are disposed. Thus, the wire harness according to the present embodiment can attach the cover member 3 to the base member 2 by moving the cover member 3 to the attachment position 28 with respect to the base member 2 even in a state in which the first connector 11 is provided in the base member 2 and the second connector 12 is fitted to the first connector 11 to electrically connect the first core wire Wa1 and the second core wire Wa2.

Second Embodiment

Next, a protector 1A and the wire harness WH1A according to the second embodiment will be described. In the following description, the same symbol is applied to the same configuration as that of the protector 1 and wire harness WH1 according to the first embodiment to omit description, and a different configuration is described.

Figure 9:
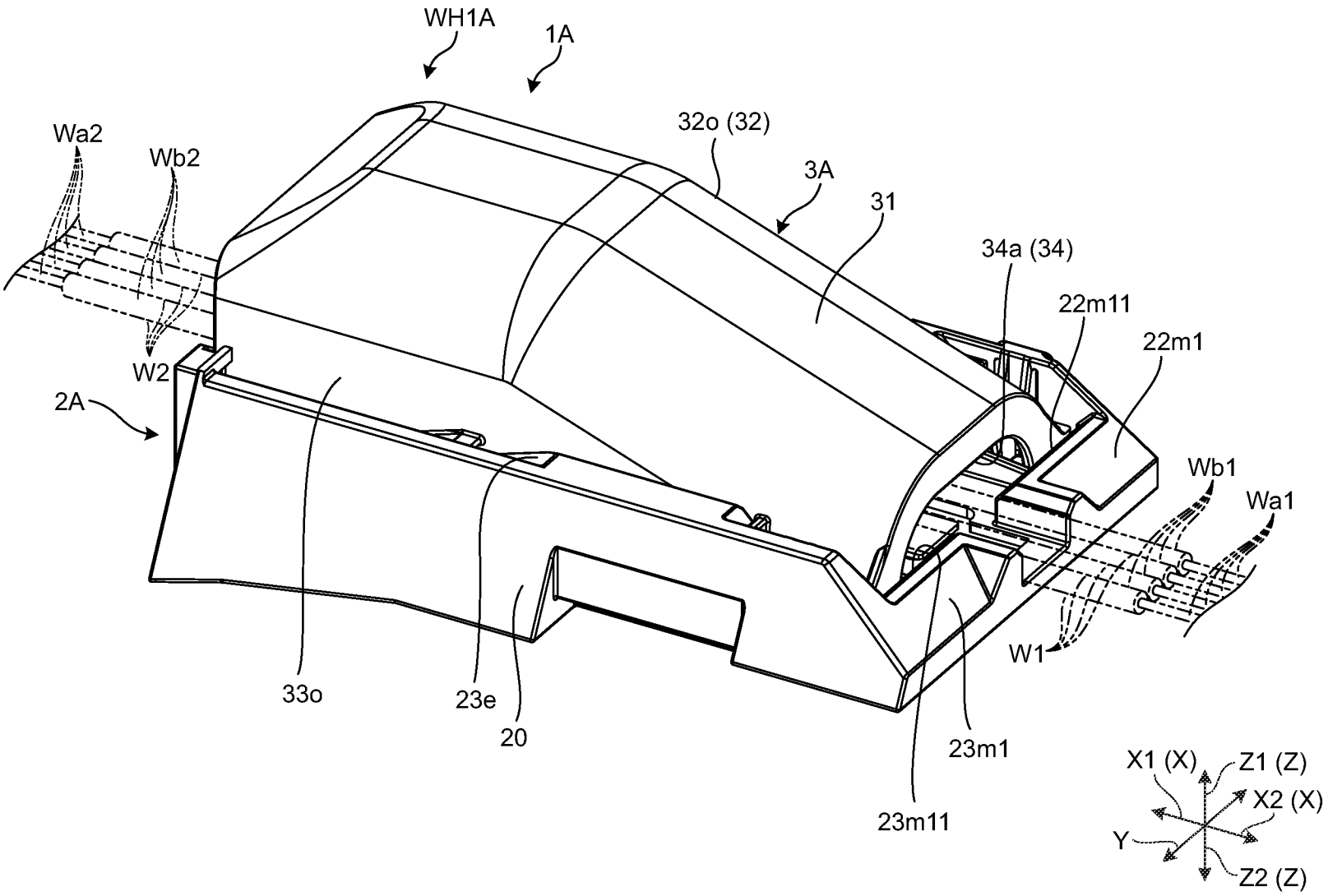
FIG. 9 is a perspective view of a wire harness including a protector according to a second embodiment.
Figure 10:
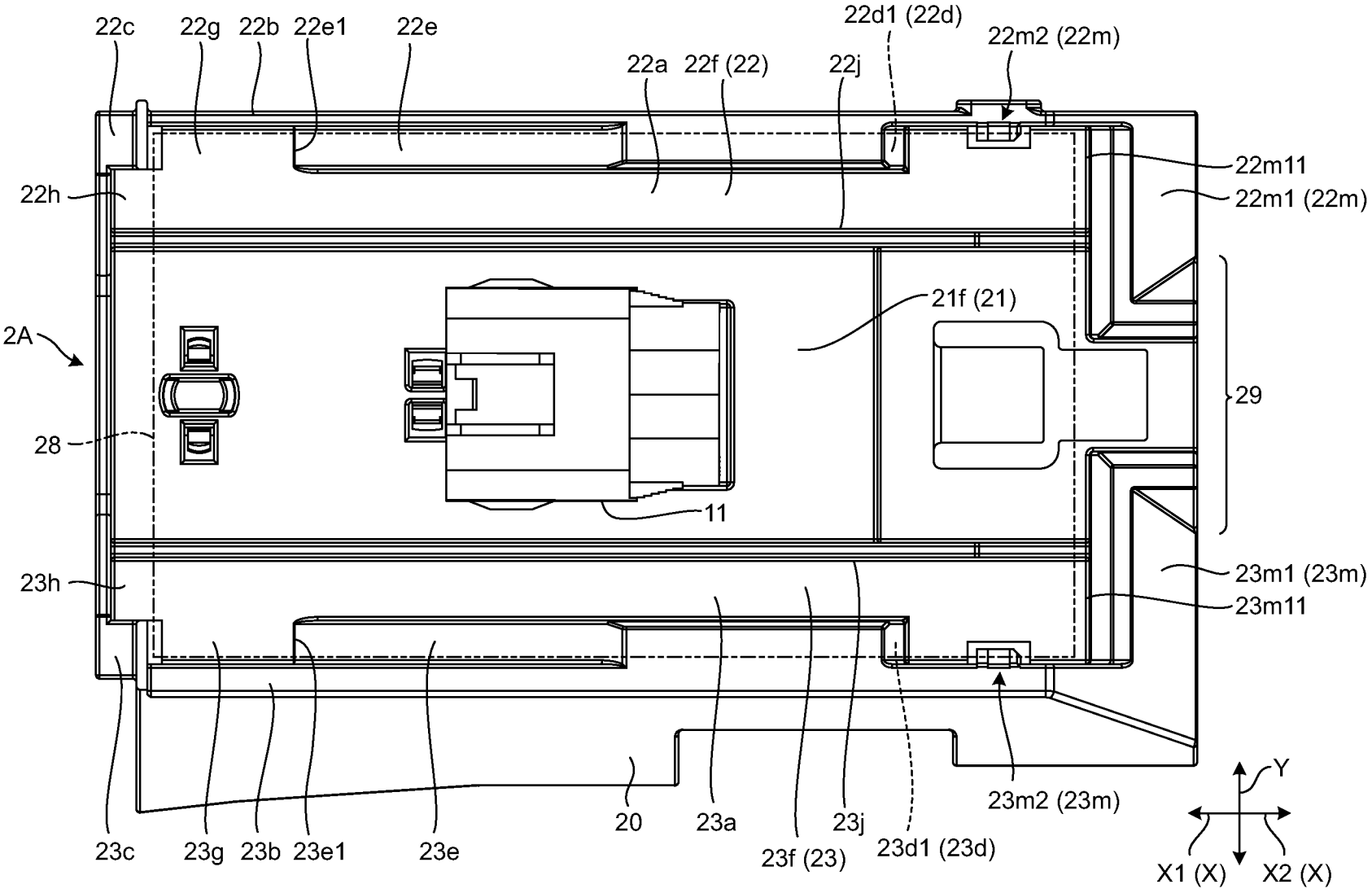
FIG. 10 is a plan view of a base member included in the protector according to the second embodiment.
Figure 11:
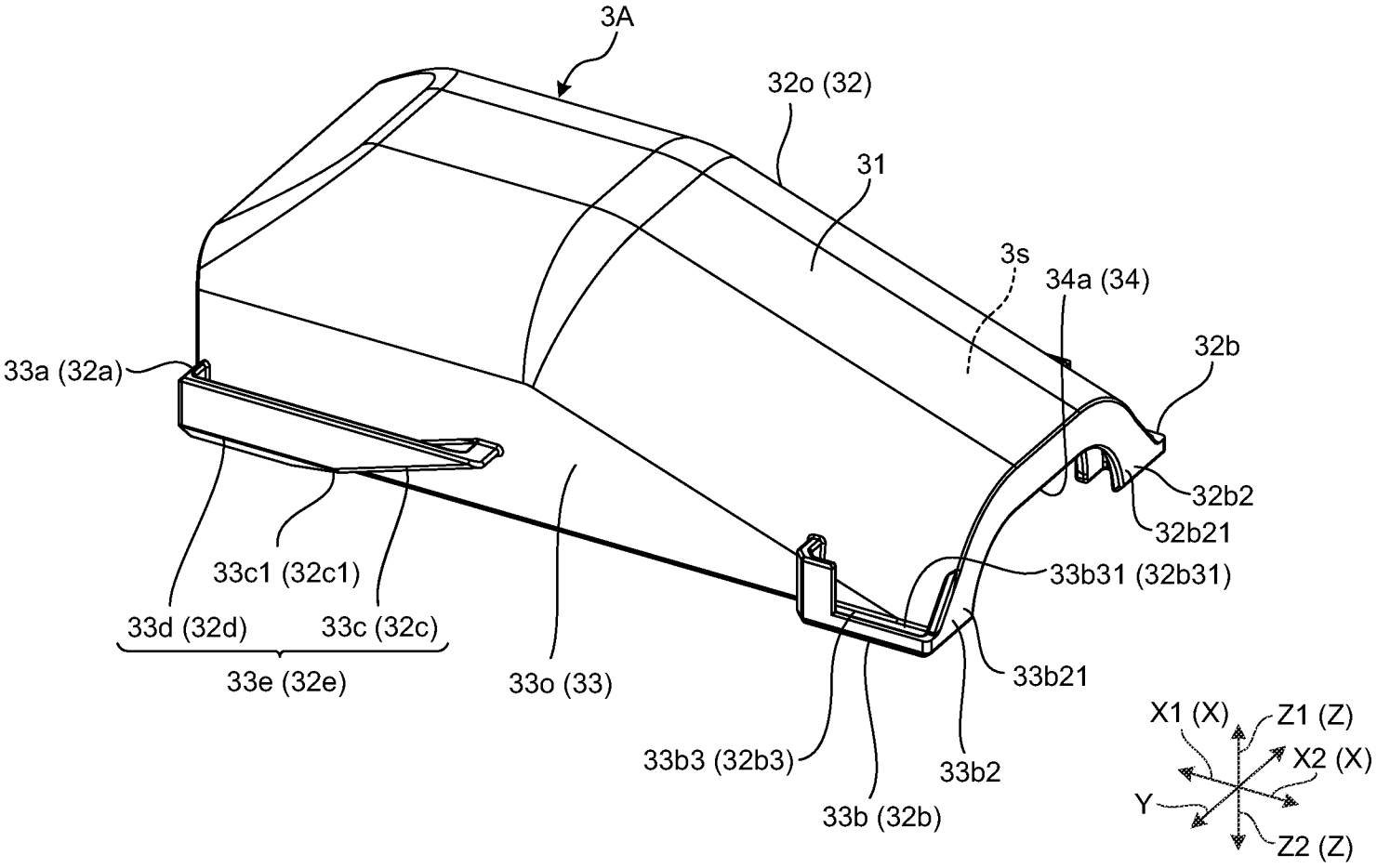
FIG. 11 is a perspective view of a cover member included in the protector according to the second embodiment.
Figure 12:
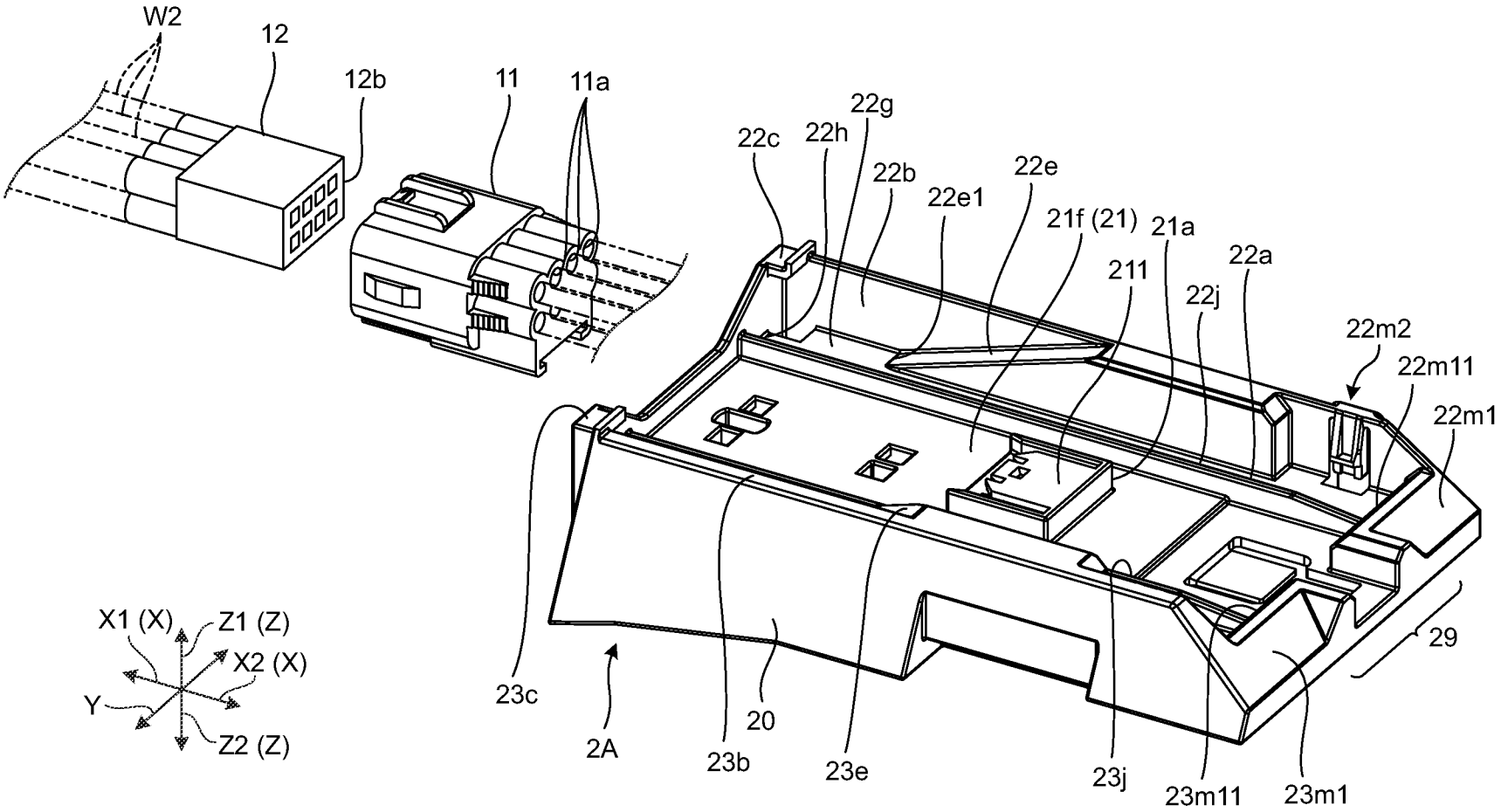
FIG. 12 is a perspective view illustrating the base member, the first connector, and the second connector of the wire harness according to the second embodiment.
Figure 13:
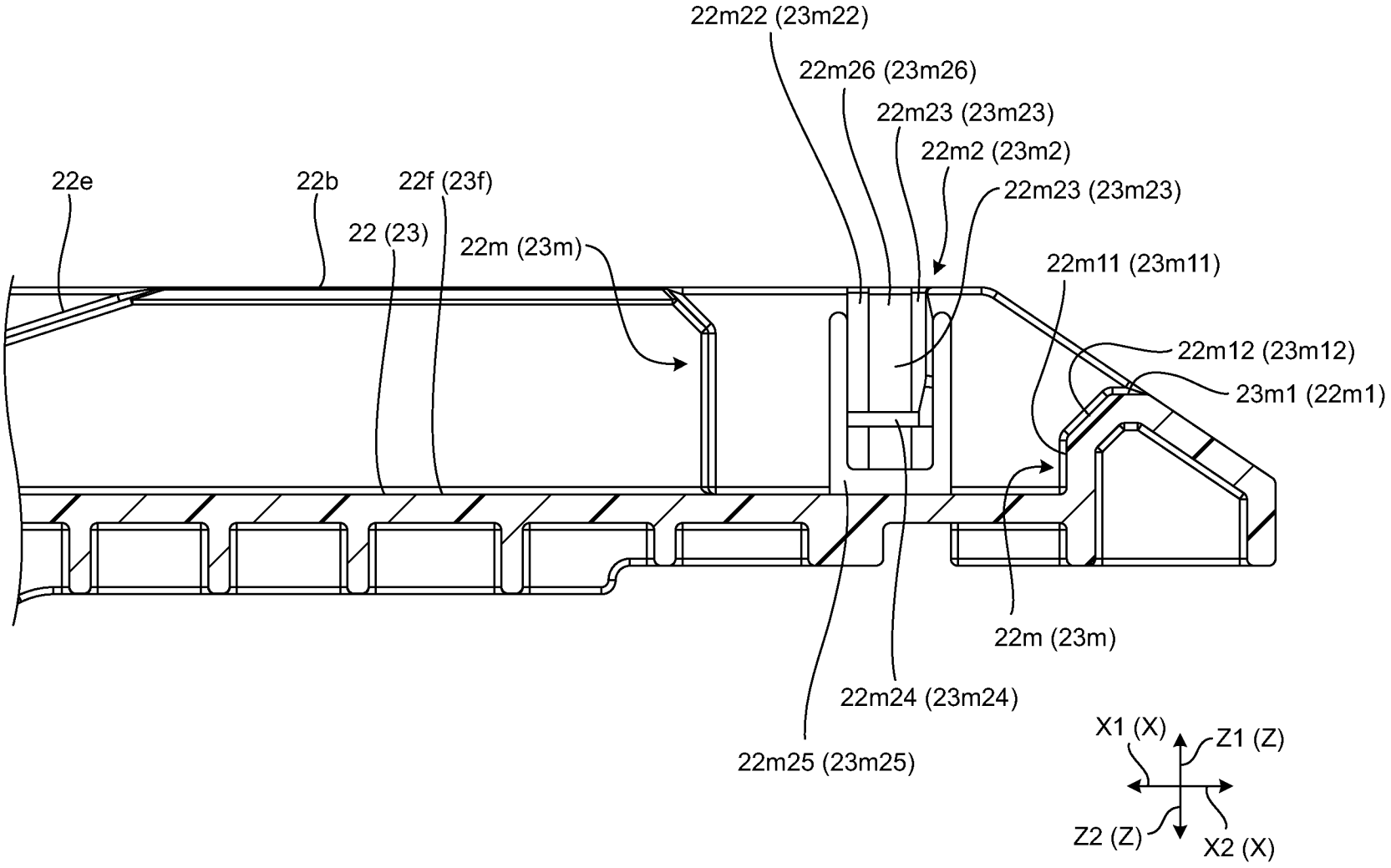
FIG. 13 is a side view illustrating a locking part included in the base member according to the second embodiment.

FIG. 9 is a perspective view of the wire harness WH1A including the protector 1A according to the second embodiment. FIG. 10 is a plan view of a base member 2A included in the protector 1A according to the second embodiment. FIG. 11 is a perspective view of a cover member 3A included in the protector 1 according to the second embodiment. FIG. 12 is a perspective view of a base member 2, a first connector 11, and a second connector 12 of the wire harness WH1A according to the second embodiment. FIG. 13 is a side view of locking parts 22*m* and 23*m* included in the base member 2A according to the second embodiment.

The wire harness WH1A according to the present embodiment includes a first wiring member W1 having a conductive first core wire Wa1, a second wiring member W2 having a conductive second core wire Wa2, the first connector 11 having a terminal of the first wiring member W1 inserted thereinto, a second connector 12 having and a terminal of the second wiring member W2 inserted thereinto, and a protector 1A that protects the first wiring member W1 and the second wiring member W2 from the outside.

The protector 1A, as illustrated in FIG. 9, includes the base member 2A and the cover member 3A that is to be attached to the base member 2A.

The base member 2A has locking parts 22*m* and 23*m* on the base bilateral-side portions 22 and 23, respectively, as illustrated in FIGS. 10, 12, and 13. The locking parts 22*m* and 23*m* are each formed as a recessed portion that is recessed downward. More specifically, the locking parts 22*m* and 23*m* are recessed portions that each have a bottom wall on the lower direction Z2 side, an opening on the upper direction Z1 side, and bilateral side walls located on both sides of the attachment/detachment direction X, and first facing walls 22*b* and 23*b* located on the outside of the width direction Y as side walls. The locking parts 22*m* and 23*m* have first locking parts 22*m*1 and 23*m*1 located at the detachment direction-side end in the locking parts 22*m* and 23*m*, and second locking parts 22*m*2 and 23*m*2 located on the attachment direction X1 with respect to the first locking parts 22*m*1 and 23*m*1, respectively.

The first locking part 22*m*1 (23*m*1) is formed by a plurality of plate-like parts and is a wall disposed at the detachment direction-side end that is outermost in each of the locking parts 22*m* and 23*m*, as illustrated in FIG. 13. The first locking part 22*m*1 (23*m*1) has a lock wall 22*m*11 (23*m*11) and a locking inclined wall 22*m*12 (23*m*12). The lock wall 22*m*11 (23*m*11) is a first lock detachment direction side facing part, and extends from the base bilateral side plane 22*f* (23*f*) toward the upper direction Z1. The locking inclined wall 22*m*12 (23*m*12) goes in the upper direction Z1 from the upper end of the lock wall 22*m*11 (23*m*11) as going in the detachment direction X2.

A pair of the second locking parts 22*m*2 and 23*m*2 are respectively provided on the facing walls 22*b* and 23*b*. The second locking part 22*m*2 (23*m*2) has a lock base 22*m*21 (23*m*21), a pair of lock facing walls 22*m*22 and 22*m*23 (23*m*22 and 23*m*23), and a lock coupling wall 22*m*24 (23*m*24).

The lock base 22*m*21 (23*m*21) is formed in a rectangular planar shape. The pair of lock facing walls 22*m*22 and 22*m*23 (23*m*22 and 23*m*23) are disposed on the lock base 22*m*21 (23*m*21) so as to face each other in the width direction Y. Out of the pair of lock facing walls 22*m*22 and 22*m*23 (23*m*22 and 23*m*23), one lock facing wall 22*m*22 (23*m*22) and the other lock facing wall 22*m*22 (23*m*22) face each other in the attachment/detachment direction X. Each of the lock facing walls 22*m*22 and 22*m*23 (23*m*22 and 23*m*23) is formed in a triangular shape, the height of which is greatest on the lower direction Z2 side in the upper/lower direction Z, and is gradually reduced toward the upper direction Z1 side. The lock coupling wall 22*m*24 (23*m*24) couples the lower ends of the lock facing walls 22*m*22 and 22*m*23 (23*m*22 and 23*m*23). The lock coupling wall 22*m*24 (23*m*24) protrudes most inward in the width direction Y of the second locking part 22*m*2 (23*m*2).

In the second locking part 22*m*2 (23*m*2), when viewed from the width direction Y, a cutout 22*m*25 (23*m*25) is disposed on three sides out of the four sides, and a lock coupled part 22*m*26 (23*m*26) coupled to the facing wall 22*b* (23*b*) is provided on the remaining one side. More specifically, when viewed from the width direction Y, the lock coupled part 22*m*26 (23*m*26) coupled to the base bilateral side base portion 22*a* (23*a*) is provided on the upper direction Z1 side. Meanwhile, when viewed from the width direction Y, the cutout 22*m*25 (23*m*25) is provided on the lower direction Z2 side, the attachment direction X1 side, and the detachment direction X2 side. When the second locking part 22*m*2 (23*m*2) is provided in the corresponding facing wall 22*b* (23*b*) as described above, the lock coupled part 22*m*26 (23*m*26) is elastically deformed, and the second locking part 22*m*2 (23*m*2) is deformed into an advancing state (see FIG. 12) in which the lock coupling wall 22*m*24 (23*m*24) advances inward in the width direction Y and a retreating state of retreating outward in the width direction Y from the advancing state.

The locked part 32*b* (33*b*) of the cover member 3A according to the present embodiment includes a first locked part 33*b*3 (32*b*3) and a second locked part 33*b*2 (32*b*2).

The first locked part 33$b$3 (32$b$3) is formed in a planar shape orthogonal to the upper/lower direction Z, and has a locked lower end 33$b$31 (32$b$31) disposed at the lower end in the upper/lower direction Z of the locked part 33$b$ (32$b$). The first locked part 33$b$3 (32$b$3) comes into contact with the lock coupling wall 22$m$24 (23$m$24) in the second locking part 22$m$2 (23$m$2) in the attachment work of the cover member 3A to the base member 2A. The first locked part 33$b$3 (32$b$3), by the coming into contact, elastically deforms the second locking part 22$m$2 (23$m$2), which is in the advancing state of advancing inward in the width direction Y, into the retreating state of retreating outward in the width direction Y. Thereafter, in a state in which the cover member 3A is moved to the attachment position 28, in the upper/lower direction Z, the lock coupling wall 22$m$24 (23$n$24) of the second locking part 22$d$2 (23$d$2), which is in the advancing state, faces the locked lower end 33$b$31 (32$b$31). Then, the lock coupling wall 22$m$24 (23$n$24) and the locked lower end 33$b$31 (32$b$31) face each other, whereby the movement of the cover member 3A toward the upper direction Z1 in the upper/lower direction Z is restricted.

The second locked part 33$b$2 (32$b$2) is formed in a planer shape orthogonal to the attachment/detachment direction X, and has a locked detachment direction-side end 33$b$21 (32$b$21) disposed at the detachment direction-side end of the locked part 33$b$ (32$b$). When the cover member 3A is moved to the attachment position 28, in the detachment direction X2, the locked detachment direction-side end 33$b$21 (32$b$21) faces the lock wall 22$m$11 (23$m$11). Thus, the movement of the cover member 3A to the detachment direction X2 is restricted.

Next, the attachment method for the wire harness WH1A according to the present embodiment will be described. First, an operator disposes the first wiring member W1 along the detachment direction X2, and attaches the first connector 11 to the connector attachment portion 21$a$ of the base member 2.

The operator then disposes the second wiring member W2 along the attachment direction X1, and fits the second connector 12 to the first connector 11. That is, the operator disposes the second wiring member W2 along the attachment direction X1, and fits the second connector 12 to the first connector 11. In a state in which the second connector 12 is fitted to the first connector 11, the base member 2 has a wiring region 29 formed on the upper surface of the base body 21, in which the first wiring member W1 and the second wiring member W2 are disposed.

Subsequently, the operator attaches the base member 2 to a vehicle body.

Next, the operator disposes the cover member 3 in the upper direction Z1 in the upper/lower direction Z of the base member 2. In this case, the cover member 3A is in an inclined state in which the attachment direction-side end of the cover member 3A is located in the lower direction Z2, and the detachment direction-side end of the cover member 3A is located in the in the upper direction Z1. When the cover member 3A is disposed in the inclined state, an aperture 35$f$ of the cover opening 35 crosses a horizontal plane including the attachment/detachment direction X and the width direction Y.

Figure 14:
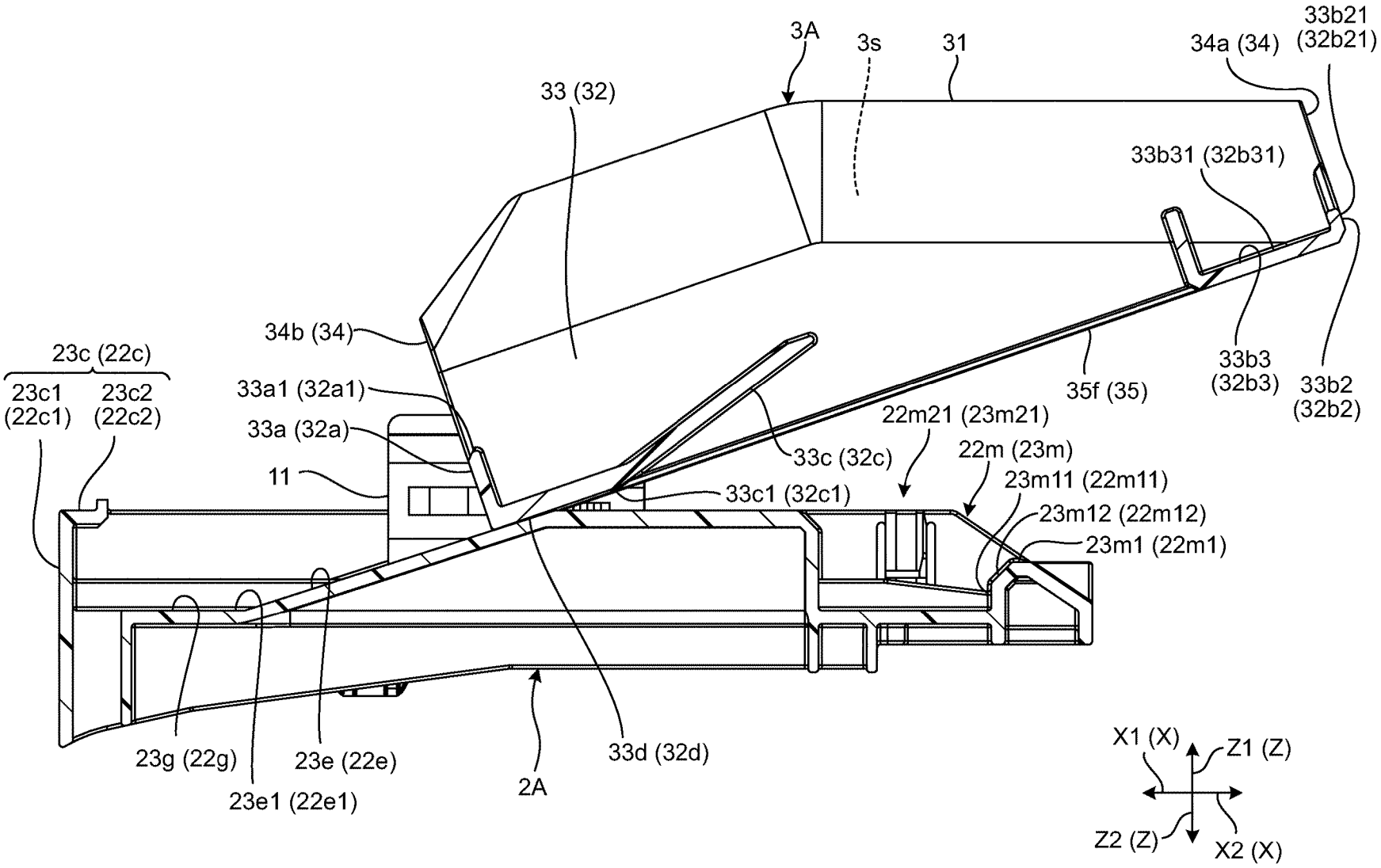
FIG. 14 is a longitudinal cross-sectional view describing the assembly of the wire harness in order in an assembly process of the wire harness according to the second embodiment.

Next, the operator moves the cover member 3 in the lower direction Z2 to bring the horizontal guided part 32$d$ (33$d$) of the cover member 3 contact into the inclined guide 22$e$ (23$e$) of the base member 2, as illustrated in FIG. 14.

Next, the operator performs the inclined direction guiding operation to move the cover member 3 in the lower direction Z2 with the horizontal guided part 32$d$ (33$d$) in contact with the inclined guide 22$e$ (23$e$). When the inclined direction guiding operation is performed, the cover member 3 goes in the attachment direction X1 as going in the lower direction Z2.

Figure 15:
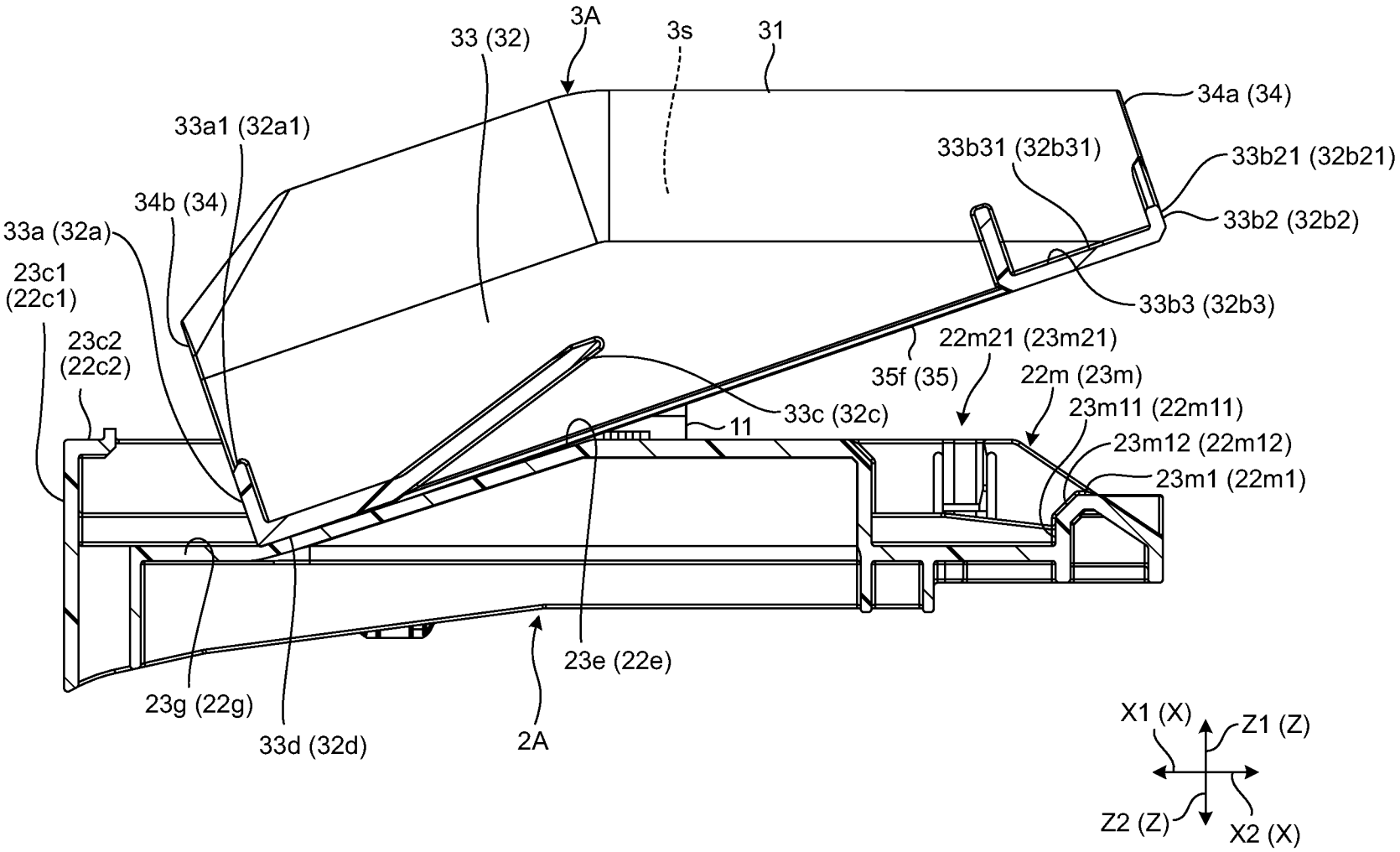
FIG. 15 is a longitudinal cross-sectional view describing the assembly of the wire harness in order in the assembly process of the wire harness according to the second embodiment.
Figure 16:
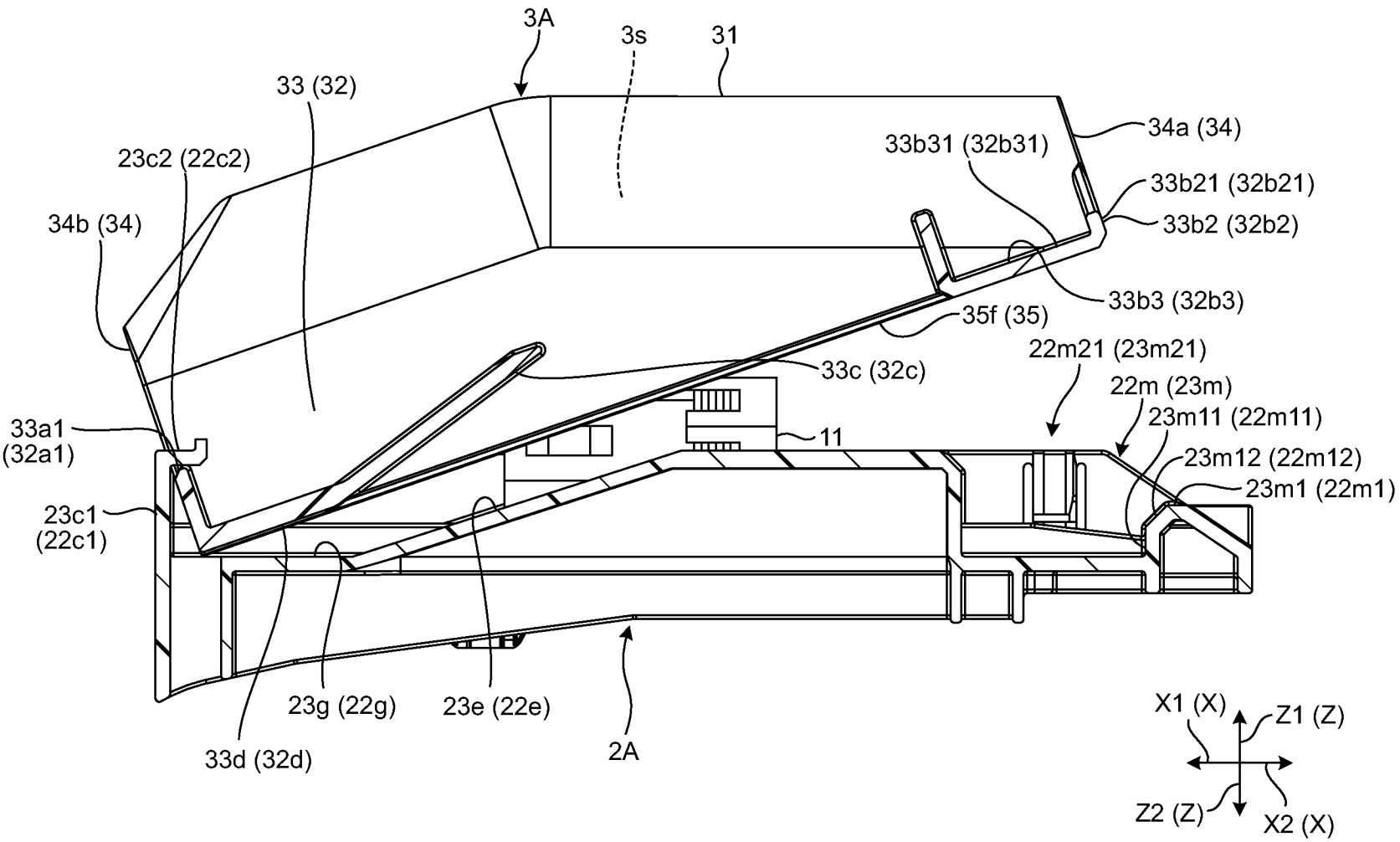
FIG. 16 is a longitudinal cross-sectional view describing the assembly of the wire harness in order in the assembly process of the wire harness according to the second embodiment.

Next, the operator moves the horizontal guided part 32$d$ (33$d$) from the inclined guide 22$e$ (23$e$) to the horizontal guide 22$g$ (23$g$), as illustrated in FIG. 15, while maintaining the contact state in which the horizontal guided part 32$d$ (33$d$) is in contact with the base member 2, and performs a horizontal guiding operation in which the cover member 3 is moved to the attachment direction X1 with the horizontal guided part 32$d$ (33$d$) in contact with the horizontal guide 22$g$ (23$g$).

Next, the operator continues the horizontal direction guiding operation, brings the hooked portion 32$a$ (33$a$) contact with the hooking portion 22$c$ (23$c$), and locks the hooked portion 32$a$ (33$a$) in the hooking portion 22$c$ (23$c$).

Next, the operator performs, in a state in which the hooked portion 32$a$ (33$a$) is locked on the hooking portion 22$c$ (23$c$), a rotation guiding operation of rotating the cover member 3A such that the detachment direction-side end of the cover member 3A is close to the detachment direction-side end of the base member 2A, around a shaft as a center that is located at the attachment direction-side end of the cover member 3A and is parallel to the width direction Y, to move the cover member 3A to the attachment position 28.

In the protector 1A, until the rotation guiding operation is performed, in the width direction Y, the locked part 32$b$ (33$b$) of the cover member 3A does not come into contact with the lock coupling wall 22$m$24 (23$m$24) of the second locking part 22$m$2 (23$m$2). Therefore, the second locking part 22$m$2 (23$m$2) is in the advancing state in which the lock coupling wall 22$m$24 (23$m$24) has advanced inward in the width direction Y. Thereafter, when the first locked part 33$b$3 (32$b$3) of the locked part 32$b$ (33$b$) and the lock coupling wall 22$m$24 (23$m$24) of the second locking part 22$m$2 (23$m$2) come into contact with each other through the rotation guiding operation, the second locking part 22$m$2 (23$m$2) is in the retreating state in which the lock coupling wall 22$m$24 (23$m$24) of the second locking part 22$m$2 (23$m$2) retreats outward in the width direction Y. Thereafter, when the cover member 3A is moved to the attachment position 28, the first locked part 33$b$3 (32$b$3) does not come into contact with the lock coupling wall 22$m$24 (23$m$24), and the second locking part 22$m$2 (23$m$2) returns to the advancing state of advancing inward in the width direction Y.

Figure 17:
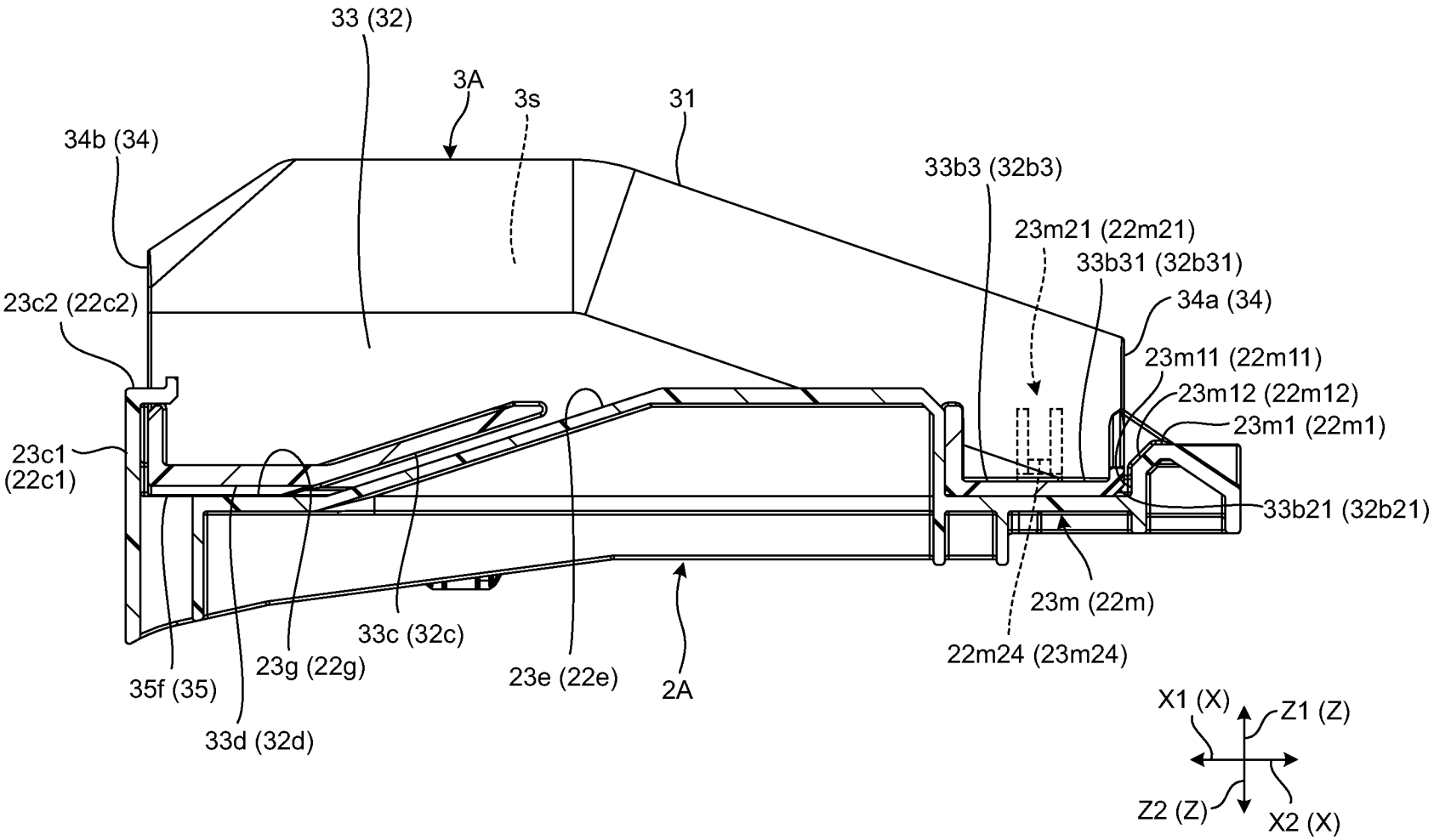
FIG. 17 is a longitudinal cross-sectional view describing the assembly of the wire harness in order in the assembly process of the wire harness according to the second embodiment.

Then, as illustrated in FIG. 17, when the cover member 3A is moved to the preset attachment position 28, the protector 1A is in the movement restricted state in which the cover opening 35 is closed by the base member 2A, the hooking portion 22$c$ (23$c$) is hooked on the hooked portion 32$a$ (33$a$), and the locking part 22$m$ (23$m$) is locked on the locked part 32$b$ (33$b$).

When the protector 1A is in the movement restricted state, the hooked portion 32$a$ (33$a$) of the cover member 3A faces the hooking portion 22$c$ (23$c$) of the base member 2A in the attachment direction X1, and the movement of the cover member 3A in the attachment direction X1 with respect to the base member 2A is restricted.

When the protector 1A is in the movement restricted state, the lock wall 22$m$11 (23$m$11) of the first locking part 22$m$1 (23$m$1) and the second locked part 33$b$2 (32$b$2) of the locked part 33$b$ (32$b$) face each other in the detachment direction X2. Thus, the protector 1A restricts the cover member 3A from moving in the detachment direction X2 with respect to the base member 2A.

Furthermore, when the protector 1A is in the movement restricted state, in the upper/lower direction Z, the hooking facing part 22*c*2 (23*c*2) of the hooking portion 22*c* (23*c*) faces the hooked upper end 32*a*1 (33*a*1) of the hooked portion 32*a* (33*a*). Besides, in the protector 1A, the lock coupling wall 22*m*24 (23*m*24) of the second locking part 22*m*2 (23*m*2) and the first locked part 33*b*3 (32*b*3) of the locked part 32*b* (33*b*) face each other in the upper/lower direction Z. By these means, the protector 1A restricts the movement of the cover member 3 in the upper/lower direction Z with respect to the base member 2.

Besides, when the protector 1A is in the movement restricted state, the cover bilateral-side portions 32 and 33 and the first facing walls 22*b* and 23*b* face each other, respectively, in the width direction Y. Thus, the protector 1A restricts the movement of the cover member 3A in the width direction Y with respect to the base member 2A.

The protector 1A according to the present embodiment has the following configuration. The pair of second locking parts 22*m*2 and 23*m*2 are formed to be elastically deformable to be close to each other or separated from each other in the width direction Y, and until the cover member 3A is moved to the attachment position 28, the locked parts 32*b* and 33*b* are inserted between the pair of second locking parts 22*m*2 and 23*m*2 in the width direction Y, and the pair of second locking parts 22*m*2 and 23*m*2 are in the retreating state of retreating outward in the width direction Y by coming into contact with the locked parts 32*b* and 33*b*, respectively. Thus, the protector 1A according to the present embodiment can use rigidity of the cover member 3A while the second locking parts 22*m*2 and 23*m*2 are in the retreating state. As a result, the protector 1A according to the present embodiment enables the operator to eliminate the need of applying a large force to the second locking parts 22*m*2 and 23*m*2 while the second locking parts 22*m*2 and 23*m*2 are in the retreating state, and thus can improve work efficiency.

Furthermore, the protector 1A according to the present embodiment has the following configuration. The first locking part 23*m*1 (22*m*1) of the base member 2A has a locking inclined wall 23*m*12 (22*m*12) that goes in the upper direction Z1 from the upper end of the lock wall 22*m*11 (23*m*11) as going in the detachment direction X2. Therefore, even when the rotation guiding operation is performed with the hooked portion 32*a* (33*a*) located slightly closer to the detachment direction X2 side with respect to the hooking portion 22*c* (23*c*), the locked detachment direction-side end 33*b*21 (32*b*21) of the cover member 3A comes into contact with the locking inclined wall 23*m*12 (22*m*12), accordingly the cover member 3A moves to the attachment direction X1 side with respect to the base member 2A, and the cover member 3A is guided toward the attachment position 28. Thus, it is possible to facilitate the attachment work of the cover member 3A to the base member 2A.

The protectors 1 and 1A, and the wire harnesses WH1 and WH1A of the above-described embodiments are described in which the inclined guide 22*e* (23*e*) is formed of a flat surface inclined at a certain angle to the attachment direction X1. However, the protectors 1 and 1A, and the wire harnesses WH1 and WH1A are not limited to those, and the inclined guide 22*e* (23*e*) may be formed of a plurality of flat surfaces. In that case, the inclined guide 22*e* (23*e*) may be formed such that angles of the respective flat surfaces to the attachment direction X1 are different from each other.

The protectors 1 and 1A, and the wire harnesses WH1 and WH1A of the above-mentioned embodiments are described in which the inclined guided part 32*c* (33*c*) is formed of a flat surface inclined at a certain angle to the attachment direction X1. However, the protectors 1 and 1A and the wire harnesses WH1 and WH1A are not limited to those, and the inclined guided part 32*c* (33*c*) may be formed of a plurality of flat surfaces. In that case, the inclined guided part 32*c* (33*c*) may be formed such that angles of the respective flat surfaces to the attachment direction X1 are different from each other.

The protectors 1 and 1A, and wiring harnesses WH1 and WH1A of the above-described embodiments can be implemented by separating part of the components of each of the embodiment and combining them with part of the components of other embodiments.

The protector and the wire harness according to the present embodiment have the configuration as described above, and thus, can facilitate the attachment operation of attaching the cover member to the base member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A protector comprising:

a base member; and a cover member that is attached to the base member, wherein the base member includes:

a base body that is located in a center in a width direction orthogonal to an upper/lower direction, and base bilateral-side portions located on both sides in the width direction, the base bilateral-side portions include:

hooking portions provided on attachment direction-side ends, a pair of inclined guides provided on a detachment direction side that is an opposite direction of the attachment direction of the hooking portion, and going in a lower direction as going in the attachment direction, a pair of horizontal guides each provided between the inclined guide and the hooking portion in the attachment direction, and extending along the attachment direction from a attachment direction-side end of the inclined guide, and a pair of locking parts provided on the detachment direction side of the inclined guide, the cover member includes an accommodating space, and a cover body that has a cover opening communicating with the accommodating space and located in the center of the width direction, and cover bilateral-side portions located on both sides in the width direction, the cover bilateral-side portions include a hooked portion that is provided at a attachment direction-side end and is hooked on the hooking portion, a pair of guided parts that are provided on the detachment direction side of the hooked portion, and come into contact with at least one of the inclined guide and the horizontal guide, and a pair of locked parts that are provided on the detachment direction side of the guided part, and locked on the locking part, and an inclined direction guiding operation is performed in which when the cover member is moved to the lower direction with the guided part coming into contact with the inclined guide, the cover member goes in the attachment direction as going in the lower direction; a horizontal guiding operation is performed to move the guided part to the horizontal guide from the inclined guide while the guided part is held to come into contact with the base member, and move the cover member to the attachment direction in a state in which the guided part comes into contact with the horizontal guide; and when the cover member is moved to a preset attachment position, the cover opening is closed by the base member and the hooking portion is hooked on the hooked portion, and a movement restricted state is performed in which the locking part is locked on the locked part, and in the movement restricted state, the movement of the cover member with respect to the base member is restricted in the attachment direction, the detachment direction, and the upper/lower direction.

2. The protector according to claim 1, wherein the guided part includes:

an inclined guided part that is provided on the cover bilateral-side portion, and comes into contact with the inclined guide before the cover member moves to the attached position; and a horizontal guided part that is provided on the cover bilateral-side portion, extends from an attachment direction-side end of the inclined guided part toward the attachment direction, and comes into contact with the horizontal guide before the cover member is moved to the attachment position, and in the inclined direction guiding operation, the inclined guide and the inclined guided part come into contact with each other, in the horizontal direction guiding operation, the horizontal guide and the horizontal guided part come into contact with each other, and moving the cover member to the attachment direction moves the cover member to the attachment position.

3. The protector according to claim 1, wherein the guided part comprises:

an inclined guided part that is provided in the cover bilateral-side portion, and faces the inclined guide in the upper/lower direction in a state in which the cover member is moved to the attachment position; and a horizontal guided part that is provided in the cover bilateral-side portion, extends to the attachment direction from the attachment direction-side end of the inclined guided part, and comes into contact with the horizontal guide in a state before at least the cover member is moved to the attachment position, in the inclined direction guiding operation, the inclined guide and the horizontal guided part come into contact with each other, in the horizontal direction guiding operation, the horizontal guide and the horizontal guided part come into contact with each other, and with the hooked portion locked in the hooking portion, a rotation guiding operation of rotating the cover member is performed such that a detachment direction-side end of the cover member is close to a detachment direction-side end of the base member, around a shaft as a center that is located at the attachment direction-side end of the cover member and is parallel to the width direction, and accordingly the cover member is moved to the attachment position.

4. The protector according to claim 2, wherein the hooking portion has a hooking facing part that faces a hooked upper end of the hooked portion in the upper/lower direction in a state in which the cover member is moved to the attachment position, the locking parts each include a first locking part located on the attachment direction-side end in the locking parts and a second locking part located on the detachment direction-side end, the first locking part includes a first locking upper end facing part that faces a locked upper end of the locked part in the upper/lower direction in a state in which the cover member is moved to the attachment position, the second locking part is formed elastically deformable in the upper/lower direction, and the locking parts each, until the cover member moves to the attachment position, are in a retreating state of retreating in the lower direction by coming into contact with the locked part in the upper/lower direction, whereas, when the cover member moves to the attachment position, the locking parts are in an advancing state of advancing in the upper direction by not coming into contact with the locked part in the upper/lower direction, and face the detachment direction-side end of the locked part in the detachment direction.

5. The protector according to claim 3, wherein the hooking portion has a hooking facing part that faces a hooked upper end of the hooked portion in the detachment direction in a state in which the cover member is moved to the attachment position, the locking parts each include a first locking part located on the attachment direction-side end in the locking parts and a second locking part located on the attachment direction side with respect to the first locking part, the first locking part includes a first lock detachment direction side facing part that faces a detachment direction-side end of the locked part in the detachment direction in a state in which the cover member is moved to the attachment position, a pair of the second locking parts are formed elastically deformable to be close to or separated from each other in the width direction, and the locking parts each, until the cover member moves to the attachment position, are in a retreating state of retreating outward in the width direction by coming into contact with the locked part in the width direction, whereas, when the cover member moves to the attachment position, the locking parts are in an advancing state of advancing inward in the width direction by not coming into contact with the locked part in the width direction, and face the locked lower end of the locked part in the upper direction of the upper/lower direction.

6. The protector according to claim 1, wherein the base member has a pair of facing walls that face each other in the width direction, and the cover member is disposed between the pair of facing walls in the width direction in a state of being disposed in the attachment position.

7. The protector according to claim 2, wherein the base member has a pair of facing walls that face each other in the width direction, and the cover member is disposed between the pair of facing walls in the width direction in a state of being disposed in the attachment position.

8. The protector according to claim 3, wherein the base member has a pair of facing walls that face each other in the width direction, and the cover member is disposed between the pair of facing walls in the width direction in a state of being disposed in the attachment position.

9. The protector according to claim 4, wherein the base member has a pair of facing walls that face each other in the width direction, and the cover member is disposed between the pair of facing walls in the width direction in a state of being disposed in the attachment position.

10. The protector according to claim 5, wherein the base member has a pair of facing walls that face each other in the width direction, and the cover member is disposed between the pair of facing walls in the width direction in a state of being disposed in the attachment position.

11. A wire harness comprising:

a first wiring member having a conductive first core wire;

a second wiring member having a conductive second core wire;

a first connector having an end of the first wiring member inserted thereinto;

a second connector having an end of the second wiring member inserted thereinto and being configured to be able to be fitted with the first connector; and the protector according to claim 1, wherein the first connector and the second connector electrically connect the first core wire and the second core wire in a fitting state, the base body is provided with the first connector, the cover body has a first through opening through which the first wiring member is inserted at the detachment direction-side end, and has a second through opening through which the second wiring member is inserted at the attachment direction-side end, the first wiring member is disposed in the base body along the detachment direction, the second wiring member is disposed in the base body along the attachment direction, and in the width direction in a state in which the second connector is fitted to the first connector, a wiring region is formed in which the first wiring member and the second wiring member are disposed between a pair of the inclined guides, between a pair of the horizontal guides, between a pair of hooking portions, and between a pair of the locking parts.

12. A wire harness comprising:

a first wiring member having a conductive first core wire;

a second wiring member having a conductive second core wire;

a first connector having an end of the first wiring member inserted thereinto;

a second connector having an end of the second wiring member inserted thereinto and being configured to be able to be fitted with the first connector; and the protector according to claim 2, wherein the first connector and the second connector electrically connect the first core wire and the second core wire in a fitting state, the base body is provided with the first connector, the cover body has a first through opening through which the first wiring member is inserted at the detachment direction-side end, and has a second through opening through which the second wiring member is inserted at the attachment direction-side end, the first wiring member is disposed in the base body along the detachment direction, the second wiring member is disposed in the base body along the attachment direction, and in the width direction in a state in which the second connector is fitted to the first connector, a wiring region is formed in which the first wiring member and the second wiring member are disposed between a pair of the inclined guides, between a pair of the horizontal guides, between a pair of hooking portions, and between a pair of the locking parts.

13. A wire harness comprising:

a first wiring member having a conductive first core wire;

a second wiring member having a conductive second core wire;

a first connector having an end of the first wiring member inserted thereinto;

a second connector having an end of the second wiring member inserted thereinto and being configured to be able to be fitted with the first connector; and the protector according to claim 3, wherein the first connector and the second connector electrically connect the first core wire and the second core wire in a fitting state, the base body is provided with the first connector, the cover body has a first through opening through which the first wiring member is inserted at the detachment direction-side end, and has a second through opening through which the second wiring member is inserted at the attachment direction-side end, the first wiring member is disposed in the base body along the detachment direction, the second wiring member is disposed in the base body along the attachment direction, and in the width direction in a state in which the second connector is fitted to the first connector, a wiring region is formed in which the first wiring member and the second wiring member are disposed between a pair of the inclined guides, between a pair of the horizontal guides, between a pair of hooking portions, and between a pair of the locking parts.

14. A wire harness comprising:

a first wiring member having a conductive first core wire;

a second wiring member having a conductive second core wire;

a first connector having an end of the first wiring member inserted thereinto;

a second connector having an end of the second wiring member inserted thereinto and being configured to be able to be fitted with the first connector; and the protector according to claim 4, wherein the first connector and the second connector electrically connect the first core wire and the second core wire in a fitting state, the base body is provided with the first connector, the cover body has a first through opening through which the first wiring member is inserted at the detachment direction-side end, and has a second through opening through which the second wiring member is inserted at the attachment direction-side end, the first wiring member is disposed in the base body along the detachment direction, the second wiring member is disposed in the base body along the attachment direction, and in the width direction in a state in which the second connector is fitted to the first connector, a wiring region is formed in which the first wiring member and the second wiring member are disposed between a pair of the inclined guides, between a pair of the horizontal guides, between a pair of hooking portions, and between a pair of the locking parts.

15. A wire harness comprising:

a first wiring member having a conductive first core wire;

a second wiring member having a conductive second core wire;

a first connector having an end of the first wiring member inserted thereinto;

a second connector having an end of the second wiring member inserted thereinto and being configured to be able to be fitted with the first connector; and the protector according to claim 5, wherein the first connector and the second connector electrically connect the first core wire and the second core wire in a fitting state, the base body is provided with the first connector, the cover body has a first through opening through which the first wiring member is inserted at the detachment direction-side end, and has a second through opening through which the second wiring member is inserted at the attachment direction-side end, the first wiring member is disposed in the base body along the detachment direction, the second wiring member is disposed in the base body along the attachment direction, and in the width direction in a state in which the second connector is fitted to the first connector, a wiring region is formed in which the first wiring member and the second wiring member are disposed between a pair of the inclined guides, between a pair of the horizontal guides, between a pair of hooking portions, and between a pair of the locking parts.

16. A wire harness comprising:

a first wiring member having a conductive first core wire;

a second wiring member having a conductive second core wire;

a first connector having an end of the first wiring member inserted thereinto;

a second connector having an end of the second wiring member inserted thereinto and being configured to be able to be fitted with the first connector; and the protector according to claim 6, wherein the first connector and the second connector electrically connect the first core wire and the second core wire in a fitting state, the base body is provided with the first connector, the cover body has a first through opening through which the first wiring member is inserted at the detachment direction-side end, and has a second through opening through which the second wiring member is inserted at the attachment direction-side end, the first wiring member is disposed in the base body along the detachment direction, the second wiring member is disposed in the base body along the attachment direction, and in the width direction in a state in which the second connector is fitted to the first connector, a wiring region is formed in which the first wiring member and the second wiring member are disposed between a pair of the inclined guides, between a pair of the horizontal guides, between a pair of hooking portions, and between a pair of the locking parts.

17. A wire harness comprising:

a first wiring member having a conductive first core wire;

a second wiring member having a conductive second core wire;

a first connector having an end of the first wiring member inserted thereinto;

a second connector having an end of the second wiring member inserted thereinto and being configured to be able to be fitted with the first connector; and the protector according to claim 7, wherein the first connector and the second connector electrically connect the first core wire and the second core wire in a fitting state, the base body is provided with the first connector, the cover body has a first through opening through which the first wiring member is inserted at the detachment direction-side end, and has a second through opening through which the second wiring member is inserted at the attachment direction-side end, the first wiring member is disposed in the base body along the detachment direction, the second wiring member is disposed in the base body along the attachment direction, and in the width direction in a state in which the second connector is fitted to the first connector, a wiring region is formed in which the first wiring member and the second wiring member are disposed between a pair of the inclined guides, between a pair of the horizontal guides, between a pair of hooking portions, and between a pair of the locking parts.

18. A wire harness comprising:

a first wiring member having a conductive first core wire;

a second wiring member having a conductive second core wire;

a first connector having an end of the first wiring member inserted thereinto;

a second connector having an end of the second wiring member inserted thereinto and being configured to be able to be fitted with the first connector; and the protector according to claim 8, wherein the first connector and the second connector electrically connect the first core wire and the second core wire in a fitting state, the base body is provided with the first connector, the cover body has a first through opening through which the first wiring member is inserted at the detachment direction-side end, and has a second through opening through which the second wiring member is inserted at the attachment direction-side end, the first wiring member is disposed in the base body along the detachment direction, the second wiring member is disposed in the base body along the attachment direction, and in the width direction in a state in which the second connector is fitted to the first connector, a wiring region is formed in which the first wiring member and the second wiring member are disposed between a pair of the inclined guides, between a pair of the horizontal guides, between a pair of hooking portions, and between a pair of the locking parts.

19. A wire harness comprising:

a first wiring member having a conductive first core wire;

a second wiring member having a conductive second core wire;

a first connector having an end of the first wiring member inserted thereinto;

a second connector having an end of the second wiring member inserted thereinto and being configured to be able to be fitted with the first connector; and the protector according to claim 9, wherein the first connector and the second connector electrically connect the first core wire and the second core wire in a fitting state, the base body is provided with the first connector, the cover body has a first through opening through which the first wiring member is inserted at the detachment direction-side end, and has a second through opening through which the second wiring member is inserted at the attachment direction-side end, the first wiring member is disposed in the base body along the detachment direction, the second wiring member is disposed in the base body along the attachment direction, and in the width direction in a state in which the second connector is fitted to the first connector, a wiring region is formed in which the first wiring member and the second wiring member are disposed between a pair of the inclined guides, between a pair of the horizontal guides, between a pair of hooking portions, and between a pair of the locking parts.

20. A wire harness comprising:

a first wiring member having a conductive first core wire;

a second wiring member having a conductive second core wire;

a first connector having an end of the first wiring member inserted thereinto;

a second connector having an end of the second wiring member inserted thereinto and being configured to be able to be fitted with the first connector; and the protector according to claim 10, wherein the first connector and the second connector electrically connect the first core wire and the second core wire in a fitting state, the base body is provided with the first connector, the cover body has a first through opening through which the first wiring member is inserted at the detachment direction-side end, and has a second through opening through which the second wiring member is inserted at the attachment direction-side end, the first wiring member is disposed in the base body along the detachment direction, the second wiring member is disposed in the base body along the attachment direction, and in the width direction in a state in which the second connector is fitted to the first connector, a wiring region is formed in which the first wiring member and the second wiring member are disposed between a pair of the inclined guides, between a pair of the horizontal guides, between a pair of hooking portions, and between a pair of the locking parts.

* * * * *